US005742873A

United States Patent [19]

Kubo et al.

[11] Patent Number: 5,742,873

[45] Date of Patent: Apr. 21, 1998

[54] IMAGE FORMING APPARATUS AND OIL CLEANING MEMBER

[75] Inventors: Takahiro Kubo; Takeshi Menjo, both of Tokyo; Takashi Hasegawa, Ageo; Yoichi Kimura, Kawaguchi; Kazuo Suzuki; Satoshi Tamura, both of Yokohama, all of Japan

[73] Assignee: Canon Kabushiki Kaisha, Tokyo, Japan

[21] Appl. No.: 327,800

[22] Filed: Oct. 24, 1994

[30] Foreign Application Priority Data

| | | | |
|---|---|---|---|
| Oct. 30, 1993 | [JP] | Japan | 5-294304 |
| Jan. 12, 1994 | [JP] | Japan | 6-014801 |
| Oct. 19, 1994 | [JP] | Japan | 6-253479 |

[51] Int. Cl.[6] ..... G03G 21/00

[52] U.S. Cl. ..... 399/98; 399/101; 399/303

[58] Field of Search ..... 355/271, 284, 355/215; 399/97, 98, 101, 303, 324, 343

[56] References Cited

U.S. PATENT DOCUMENTS

| | | | |
|---|---|---|---|
| 4,501,482 | 2/1985 | Stryjewski | 355/284 X |
| 4,568,174 | 2/1986 | Stange | 355/300 |
| 4,743,943 | 5/1988 | Adams et al. | 355/284 |
| 5,019,871 | 5/1991 | Takeda et al. | 355/309 |
| 5,075,732 | 12/1991 | Menjo | 355/271 X |
| 5,289,245 | 2/1994 | Menjo | 355/284 |
| 5,353,106 | 10/1994 | Agarwal et al. | 355/284 X |

*Primary Examiner*—Fred L. Braun

*Attorney, Agent, or Firm*—Fitzpatrick, Cella, Harper & Scinto

[57] ABSTRACT

An image forming apparatus includes a recording material supporting member for supporting and transporting a recording material, an image forming device for forming an image on the recording material supported by the recording material supporting member, and a polishing device, having polishing particles provided on the surface thereof and a holding portion for holding the polishing particles, for polishing the recording material supporting member.

66 Claims, 15 Drawing Sheets

IMAGE FORMING APPARATUS AND OIL CLEANING MEMBER

BACKGROUND OF THE INVENTION

1. Field of the Invention

The present invention relates to an image forming apparatus of electrophotographic or electrostatic recording type, and, more particularly to a color image forming apparatus in which a recording material is supported on a recording material supporting member and visible images of plural colors, formed on an image bearing member, are transferred in superposed manner onto a same recording material. Also the present invention relates to an oil cleaning member adapted to be mounted on an image forming apparatus such as a copying machine or a laser beam printer.

2. Description of the Related Art

In the following there will be explained, with reference to FIG. 14, a color image forming apparatus for forming a full color image.

In this example of the color image forming apparatus, a photosensitive drum (image bearing member) 1 is supported so as to be rotatable in a direction indicated by an arrow, and a corona charger 2, an optical system 3, a developing unit 4, a transfer unit 5 and a cleaning unit 6 are provided around the photosensitive drum 1. The optical system 3 is comprised of an original scanning unit and color separation filters, and comprised for, for example, of a laser beam exposure unit for irradiating the photosensitive drum 1 with a color separated optical image or an equivalent optical image E.

The photosensitive drum 1, uniformly charged by the charger 2, is irradiated with the optical image E, for each separated color, to form an electrostatic latent image. The developing unit 4 of the fixed type is comprised of four developing units, namely a yellow developing unit 4*y*, a cyan developing unit 4*c*, a magenta developing unit 4*m* and a black developing unit 4*bk*, positioned along the periphery of the photosensitive drum 1. The latent image on the photosensitive drum 1 is developed by said developing unit, whereby a visible image is formed on said drum 1 with toner principally composed of resin.

The toner image on the photosensitive drum 1 is transferred onto a recording material, which is supplied from a recording material cassette 7, through a transport system and a transfer unit 5 (along a broken-lined sheet path), to a position opposed to the photosensitive drum 1. The transfer unit 5 of this example is provided with a transfer drum 5*a*, a transfer corona charger 5*b*, an attraction corona charger 5*c* for electrostatic attraction of the recording material, an attraction roller 5*g* opposed thereto, an internal corona charger 5*d* and an external corona charger 5*e*, and a recording material supporting sheet 5*f* of a dielectric material is cylindrically provided on the periphery of the rotatably supported transfer drum 5*a*.

Along with the rotation of the transfer drum 5*a* in the direction indicated by an arrow, the toner image on the photosensitive drum 1 is transferred, by the transfer charger 5*b*, onto the recording material supported on the recording material supporting sheet 5*f*. Color images of a desired number are thus transferred on the recording material supported by attraction on the recording material supporting sheet 5*f* whereby a full-color image is obtained.

After the transfer of the toner images of a desired number in this manner, the recording material is separated from the transfer drum 5*a* by separating means 8 and is discharged, through a heat roller fixing unit 9, to a tray 10. After the image transfer, the photosensitive drum 1 is subjected to the cleaning of the toner remaining on the surface by the cleaning unit 6, and is then used again for image formation.

However, in such a prior image forming apparatus, when the recording material is repeatedly attracted to the recording material supporting sheet, constituting the recording material support member of the transfer unit, the recording material is often not attracted sufficiently but tends to peel off, thereby resulting in sheet jamming. This phenomenon results from decrease of the attracting force of the recording material supporting sheet, with the lapse of time of use of the apparatus. More specifically, paper powder detached from paper constituting the principal recording material is deposited on the recording material supporting sheet, thereby dissipating the charge inducing the electrostatic attraction of the recording material to the recording material supporting sheet.

This drawback becomes conspicuous under high humidity and also in a case where the photosensitive drum constituting the image bearing member has a small curvature. Also in a case where thick paper is used as the recording material, there is required a larger electrostatic attractive force, so that the above-mentioned drawback becomes more serious.

In the fixing unit 9 of the above-explained full-color image forming apparatus, the fixing roller 9*a* is generally coated thereon with oil. Such oil coating is essential for extending the service life of the fixing roller 9*a* itself, and for preventing the offset of the toner, to be fixed onto the recording material, to said fixing roller 9*a*. Consequently, at the fixing operation, the oil is inevitably transferred, though in a slight amount, onto the recording material. Therefore, in a so-called two-side or both-face image forming operation in which the image is formed also on the second face of the recording material, it is supported on the transfer drum 5*a* with its first face, bearing thus transferred oil thereon, in contact with the transfer drum 5*a*, so that the oil is transferred onto the surface thereof, and is further transferred from the transfer drum 5*a* to the photosensitive drum 1 at the image transfer area where the two drums are in mutual contact.

For this reason, if the two-side image formation is conducted particularly on a number of sheets in continuous manner, a considerable amount of oil is deposited on the surface of the photosensitive drum 1. If the image formation is conducted thereafter, there will result, because of the adhesive force of oil, drawbacks such as background fog caused by deposition of toner in an area of the recording material P which should remain white, or an insufficient image density caused by insufficient toner transfer from the photosensitive drum 1 in an area which should appear as solid black.

SUMMARY OF THE INVENTION

In consideration of the foregoing, an object of the present invention is to prevent loss of the attracting force of the recording material support member to the recording sheet.

Another object of the present invention is to provide an image forming apparatus enabling the use of an image bearing member of a large diameter.

Still another object of the present invention is to provide a cleaning member capable of satisfactorily removing the oil deposited on a member to be cleaned.

Still another object of the present invention is to provide an image forming apparatus capable of efficiently removing the oil deposited on the recording material support member.

Still other objects of the present invention, and the features thereof, will become fully apparent from the following detailed description, which is to be taken in conjunction with the attached drawings.

DETAILED DESCRIPTION OF THE PREFERRED EMBODIMENTS

In the following there will be explained, in detail, the image forming apparatus of the present invention, in particular the transfer unit featuring such apparatus, with reference to the attached drawings, wherein same components as those already explained before are represented by same numbers and will not be explained further.

[Embodiment 1]

Figure 1:
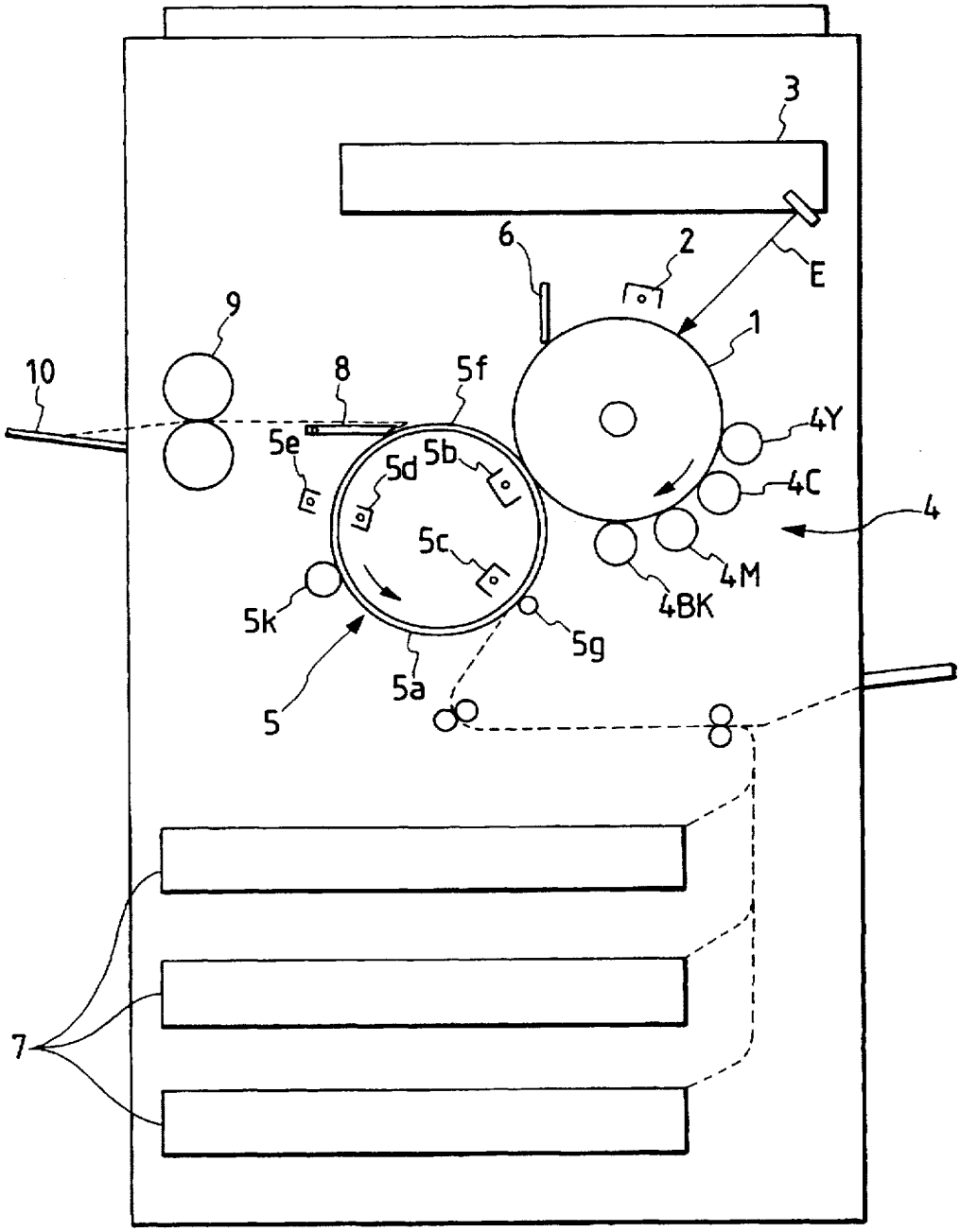
FIG. 1 is a schematic view of an image forming apparatus, constituting an embodiment 1 of the present invention.
Figure 14:
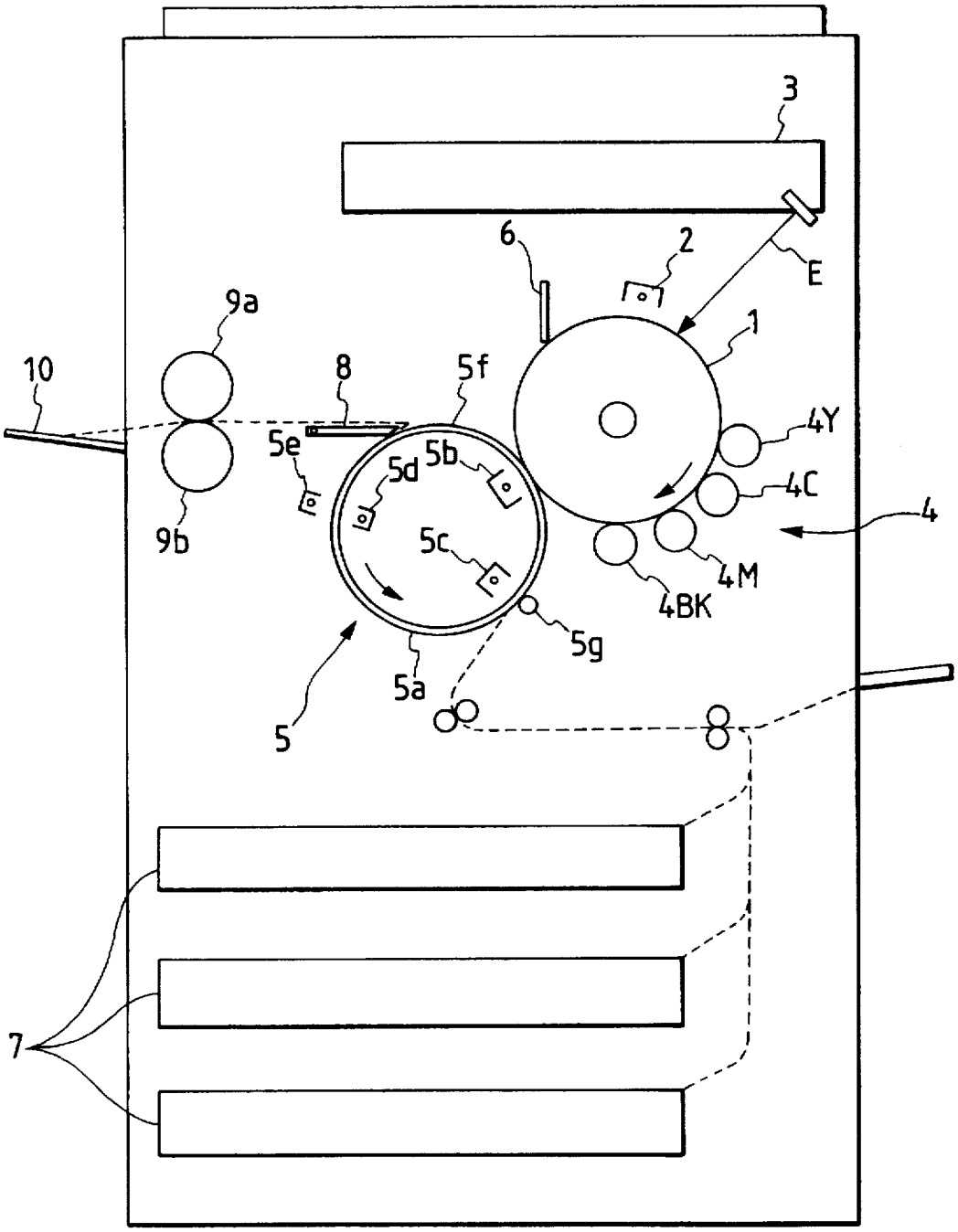
FIG. 14 is a schematic view of a color image forming apparatus.

The image forming apparatus of the present embodiment is similar, in structure, to the color image forming apparatus shown in FIG. 14, but is different therefrom in that, as shown in FIG. 1, the transfer unit 5 is provided with a polishing roller **5*k*, constituting polishing means for polishing the surface of the recording material supporting sheet 5*f***.

Figure 2:
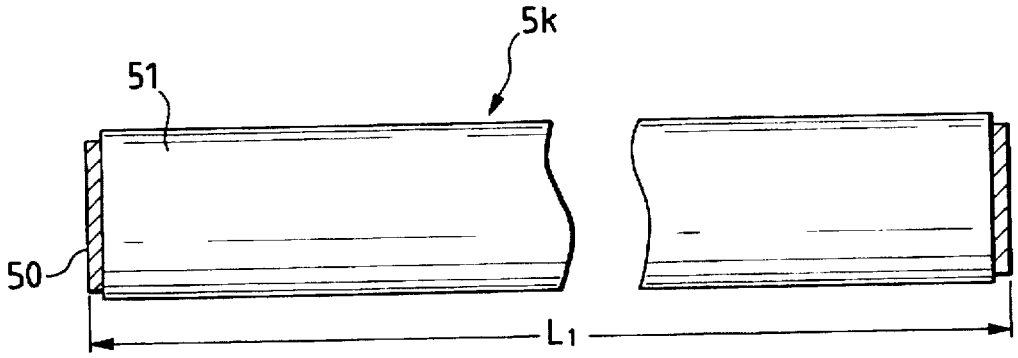
FIG. 2 is an elevation view of a polishing roller of the image forming apparatus shown in FIG. 1.
Figure 3:
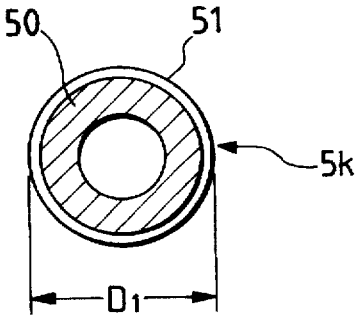
FIG. 3 is a lateral view of the roller in FIG. 2.

As shown in FIGS. 2 and 3, the polishing roller **5*k* is principally comprised of an aluminum pipe 50 constituting a substrate, and a polishing sheet 51 wound therearound. The polishing sheet 51 is comprised of alumina particles, as a polishing agent, adhered uniformly on a resinous sheet, the alumina particles thereby being held by the resinous sheet, which thus acts as a holding portion. A polishing roller 5*k* has a longitudinal length L1 of 300 mm and a diameter D1 of 20 mm. The polishing roller 5*k* is rendered rotatable about the central axis of the aluminum pipe 50 by a motor (not shown), and is also rendered capable of rocking motion by an eccentric cam (not shown), whereby it can be brought into contact with and separated from the recording material supporting sheet 5*f***.

In the present embodiment, the polishing roller **5*k*** is activated:

(i) when the number of copies reaches 1,500 after the previous activation of the polishing roller; or (ii) when the main switch of the apparatus is once turned off and then turned on while the number of copies is within a range from 1,000 to 1,500 after the previous activation of the polishing roller.

During the function of the polishing roller, the apparatus enters a stand-by state, in order to prevent other components from arbitrary functions.

Figure 4:
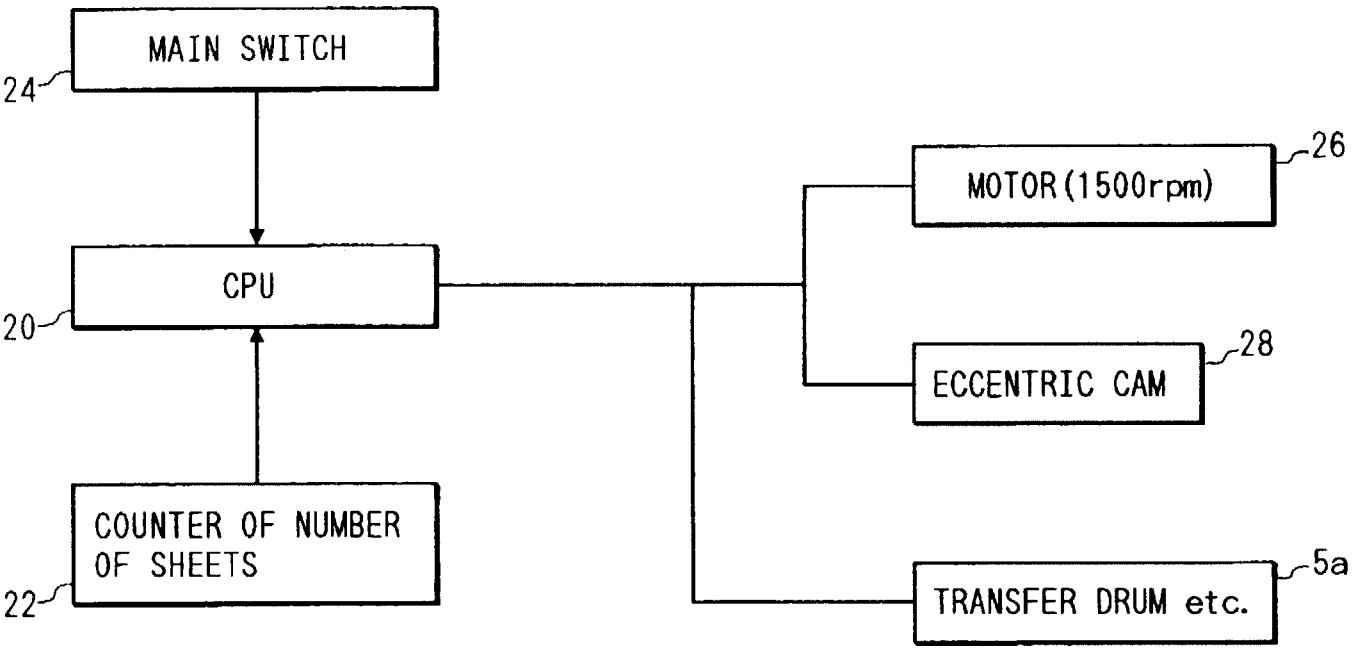
FIG. 4 is a block diagram showing the control of the function of the polishing roller.

Now reference is made to FIG. 4, for explaining the control of the function of the polishing roller. Signals from a copy number counter 22 and a main switch 24 are administered by a CPU 20 incorporated in the image forming apparatus. The CPU 20 memorizes the value of the counter 22 when the polishing roller is activated, and, when the number of copies reaches 1,500 from the previous activation or from the state of a count zero, activates the motor 26 and the eccentric cam 28 and simultaneously rotates the transfer drum **5*a*, thereby polishing the recording material supporting sheet 5*f*. The motor 26** is set, for example, at a revolution rate of 1,500 rpm.

The direction of rotation of the polishing roller **5*k* relative to the recording material supporting sheet 5*f***, and the number of rotations required for satisfactory polishing can be determined according to the experimental results, as shown in Table 1.

TABLE 1

| Required number of turns of polishing roller as a function of revolution and rotating direction | | |
|---|---|---|
| Polishing roller | Required number of turns of polishing roller | |
| rev. (rpm) | Forward | Reverse |
| 500 | from 65 up | from 55 up |
| 1000 | from 40 up | from 35 up |
| 1500 | from 25 up | from 20 up |
| 2000 | from 25 up | from 20 up |
| 2500 | from 25 up | from 20 up |

Figure 5:
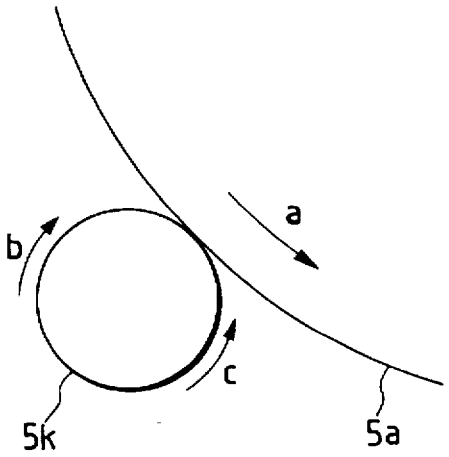
FIG. 5 is a schematic view showing the rotating direction of the polishing roller.

Table 1 indicates, for example, that a rotation of 40 turns is appropriate when the polishing roller is rotated in the forward direction with a revolution of 1,000 rpm. The rotation of the polishing roller is considered forward or reverse respectively in the direction b or c shown in FIG. 5, when the transfer drum **5*a*** is rotated in a direction a.

It is desirable to use an image bearing member of a larger diameter for image quality improvement and speed increase of the image formation, but, as already explained before, a smaller curvature of the image bearing member enhances the peeling of the recording material from the recording material supporting sheet. Such peeling becomes particularly conspicuous in case $Y \geqq X/2$, wherein X is the radius of curvature of the recording material supporting member at the image transfer position and Y is the radius of curvature of the image bearing member. Consequently the polishing of the recording material supporting member becomes more necessary in order to prevent peeling. Particularly in case of $Y \geqq X/1.1$, the polishing of the recording material supporting member becomes even more necessary for preventing such peeling.

The polishing of the recording material supporting sheet with the polishing roller under certain conditions can prevent the loss of attractive force on the recording material, thereby resolving the drawbacks such as sheet jamming, as explained in the foregoing.

[Embodiment 2]

Figure 6:
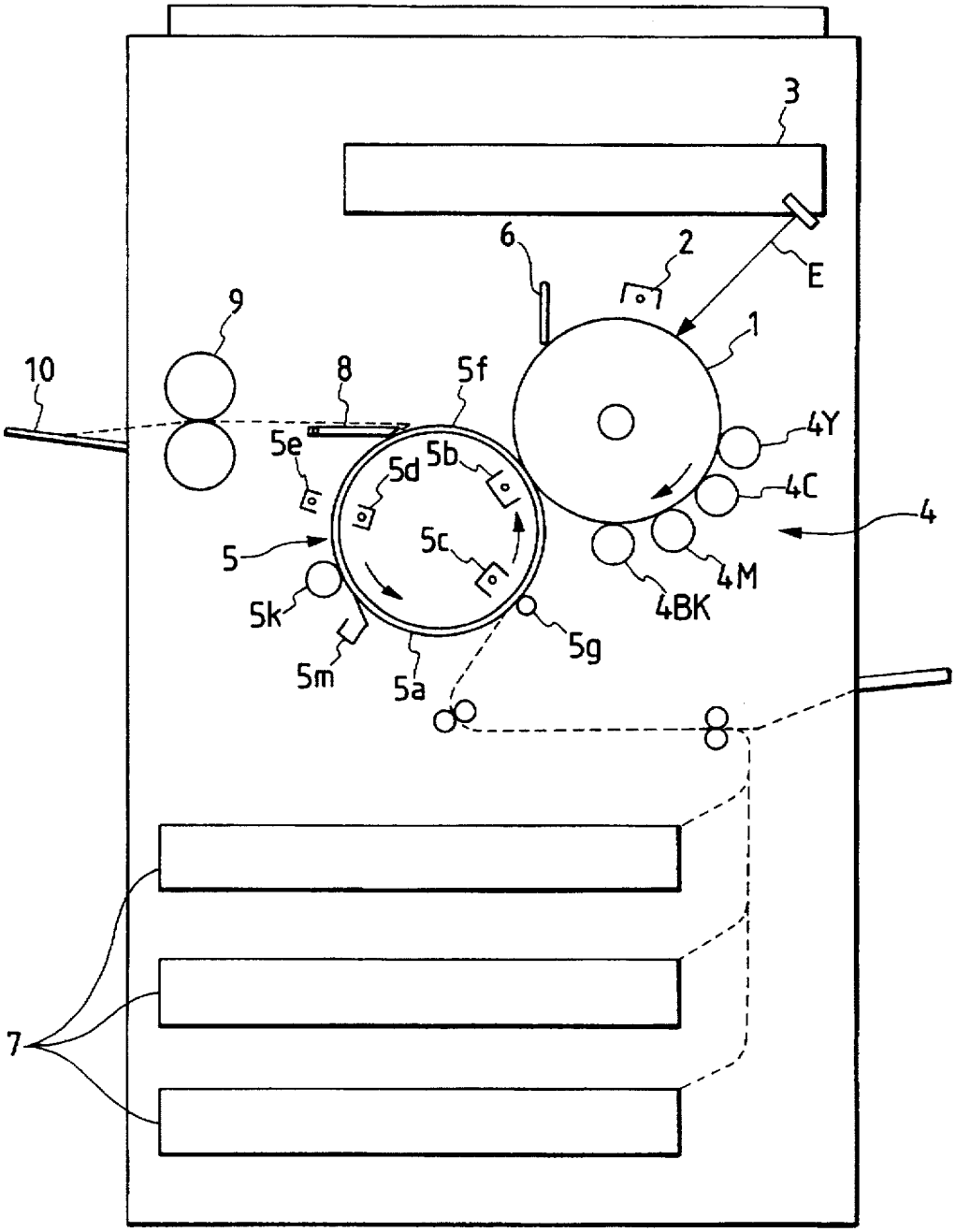
FIG. 6 is a schematic view of an image forming apparatus, constituting an embodiment 2 of the present invention.

In the following there will be explained an embodiment 2 of the image forming apparatus of the present invention with reference to FIG. 6. The present embodiment 2 is also substantially similar, in structure, to the conventional color image forming apparatus explained with reference to FIG. 14, but is different in that it is equipped, in addition to the polishing roller in the embodiment 1, with a scraper *5m* for recovering powder, generated from the recording material supporting sheet *5f* by the polishing operation of the polishing roller *5k*. The polishing roller *5k* will not be explained further as it is similar, in structure and function, to that in the embodiment 1.

In the present embodiment 2, a scraper *5m* is provided at the downstream side of the polishing roller *5k*, with respect to the rotating direction of the transfer drum *5a*, for the purpose of recovering the powder, generated from the recording material supporting sheet *5f*, by the polishing operation of the polishing roller *5k*. It is therefore made possible to prevent contamination in the apparatus by the powder generated by the function of the polishing roller *5k*, in addition to the effects similar to those in the embodiment 1.

[Embodiment 3]

In the following there will be explained, with reference to FIG. 7, an embodiment 3 of the image forming apparatus of the present invention. Also this embodiment is substantially similar, in structure, to the conventional color image forming apparatus explained with reference to FIG. 14, but is different therefrom in that the function of the polishing roller is controlled according to the temperature and humidity in the image forming apparatus. The polishing roller *5k* itself will not be explained further as it is same, in structure and function, as that in the embodiment 1.

Figure 7:
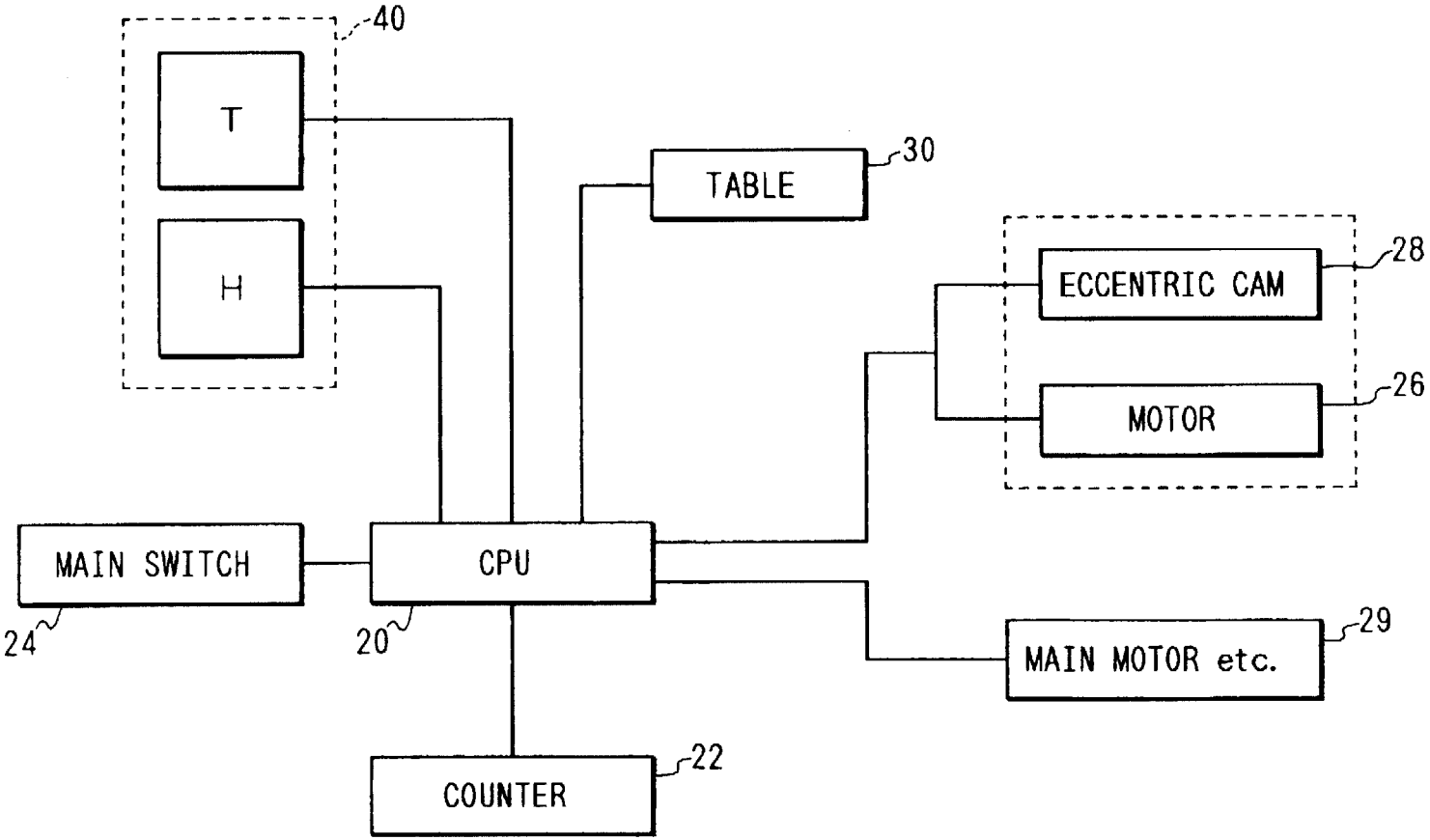
FIG. 7 is a block diagram showing the control of the function of the polishing roller in the image forming apparatus of an embodiment 3 of the present invention.

Referring to FIG. 7 which is a block diagram showing the control of the function of the polishing roller, signals from a copy number counter 22, a main switch 24 and a main motor 29 are administered by a CPU 20 incorporated in the image forming apparatus. The CPU 20 memorizes the value of the counter 22 when the polishing roller is activated, and, when the number of copies reaches 1,500 from the previous activation or from the state of a count zero, activates the motor 26 and the eccentric cam 28 and simultaneously rotates the transfer drum *5a*, thereby polishing the recording material supporting sheet *5f*.

In the present embodiment 3, there is provided a temperature-humidity sensor 40 for detecting the temperature T and the humidity H in the image forming apparatus. The temperature and humidity, detected by the sensor 40, are used, with reference to a table 30, for calculating the absolute moisture amount, based on which the function of the polishing roller is controlled.

In the present embodiment 3, the function of the polishing roller is differentiated at a moisture amount of 10.5 g, contained in 1 kg of air at a temperature of 23° C. and a humidity of 60%. The paper powder deposited on the transfer drum *5a* lowers electrical resistance by the absorption of moisture contained in the air, and the attracting charge is dissipated through the paper powder of thus lowered resistance, whereby the recording material becomes more easily peelable from the transfer drum *5a*.

In the present embodiment 3, therefore, the polishing roller is activated when the number of copies reaches a predetermined value while the absolute moisture amount, calculated from the result of detection of the temperature-humidity sensor 40, is equal to or more than 10.5 g/kg. As the function of the polishing roller is inhibited when the absolute moisture amount is equal to or less than 10.5 g/kg, the present embodiment 3 can achieve effective function of the polishing roller and avoid excessive polishing operation. It is therefore rendered possible to alleviate the burden to the recording material supporting sheet at the function of the polishing roller, in addition to the effects same as in the embodiment 1.

[Embodiment 4]

In the following there will be explained an embodiment 4 of the image forming apparatus of the present invention, with reference to FIGS. 8 and 9. The image forming apparatus of this embodiment 4 is also substantially similar, in structure, to the conventional color image forming apparatus explained with reference to FIG. 14, and is different in that the transfer unit 5 is equipped with a fur brush *5k'* as polishing means for polishing the surface of the recording material supporting sheet *5f*.

Figure 8:
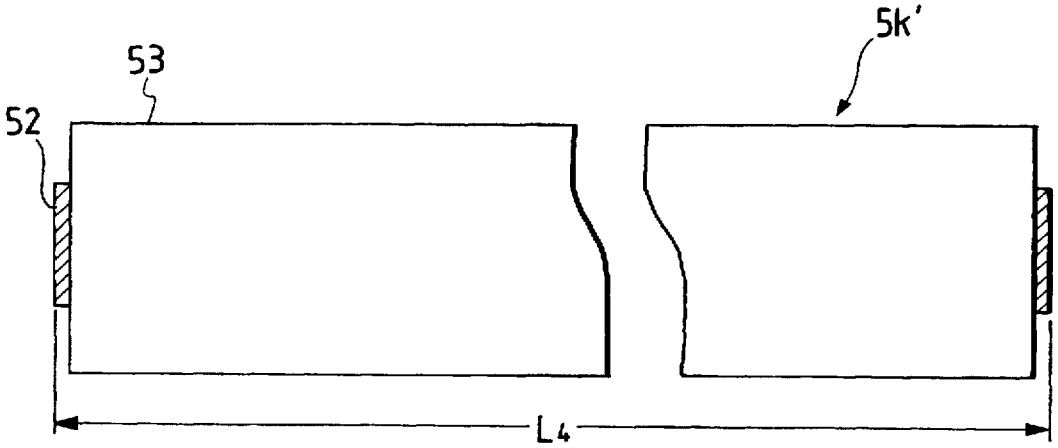
FIG. 8 is an elevation view of fur brush-shaped polishing means.
Figure 9:
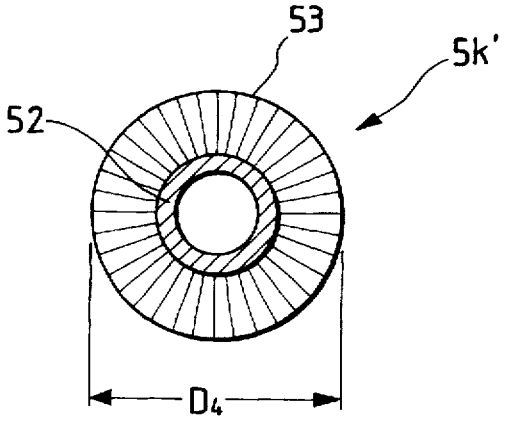
FIG. 9 is a lateral view of fur brush-shaped polishing means shown in FIG. 8.

As shown in FIG. 8 and 9, the fur brush *5k'* is principally comprised of a core member 52 and a brush member 53 formed around said core member 52. Said brush member 53 is comprised of a material having hardness and rigidity capable of polishing the recording material supporting sheet *5f*. The fur brush *5k'* has a longitudinal length L4 of 300 mm, and a diameter D4 of 300 mm.

The use of such fur brush as the polishing member for the recording material supporting sheet allows to provide effects similar to those of the embodiment 1.

[Embodiment 5]

In the following there will be explained an embodiment 5 of the image forming apparatus of the present invention, with reference to FIGS. 10 to 12. The image forming apparatus of the present embodiment is similar, in structure, to the conventional color image forming apparatus shown in FIG. 14, except that the transfer unit 5 is equipped with a rocking polishing member *5k"* as the polishing means for polishing the surface of the recording material supporting sheet *5f*.

Figure 10:
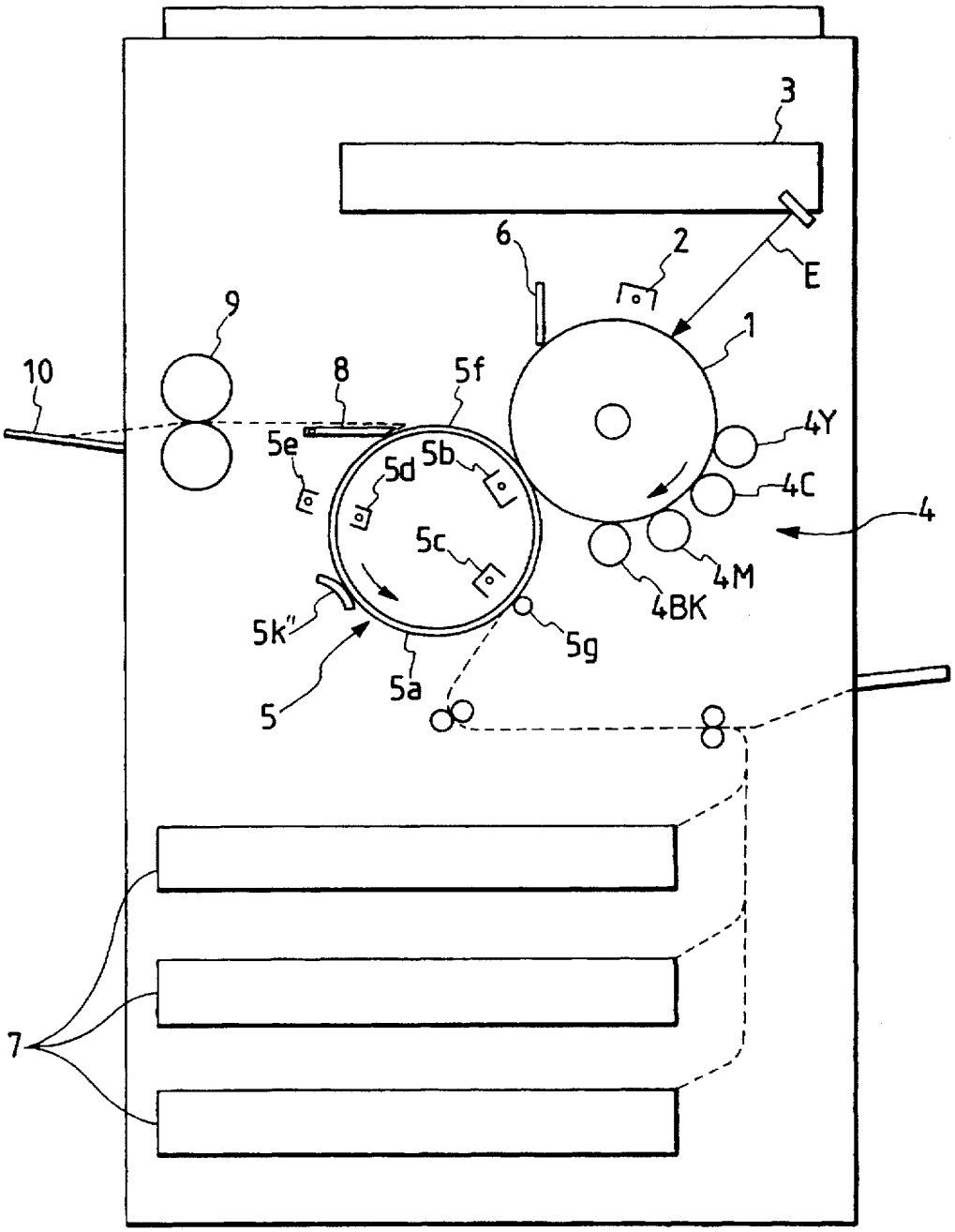
FIG. 10 is a schematic view of an image forming apparatus, constituting an embodiment 5 of the present invention.
Figure 11:
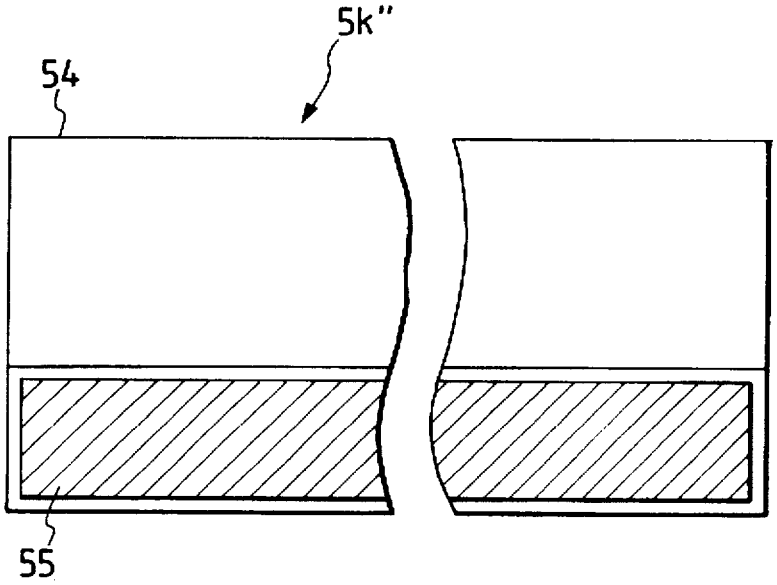
FIG. 11 is an elevation view of a rocking polishing member in the embodiment 5.
Figure 12:
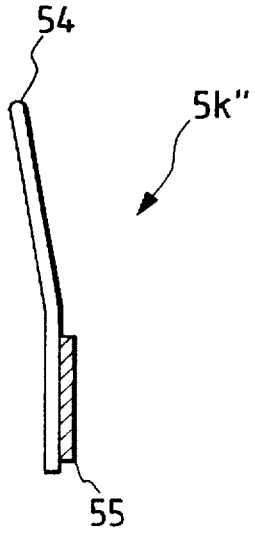
FIG. 12 is a lateral view of the rocking polishing member shown in FIG. 11.

The rocking polishing member *5k"* of the present embodiment 5 is provided, as shown in FIG. 10, at the downstream side of the external corona charger *5c*, with respect to the rotating direction of the transfer drum *5a*, and is principally comprised, as shown in FIGS. 11 and 12, of a supporting metal plate 54 extended in the longitudinal direction of the transfer drum *5a* and a polishing sheet 55 adhered on the substantially lower half of the supporting metal plate 54, and is rendered capable, by a solenoid (not shown), of rocking motion so as to be brought into contact with and separated from the recording material supporting sheet *5f*.

It is thus rendered possible to prevent the loss in the attractive power of the recording material supporting sheet on the recording material as in the embodiment 1, thereby avoiding the drawbacks such as sheet jamming.

[Embodiment 6]

Figure 13:
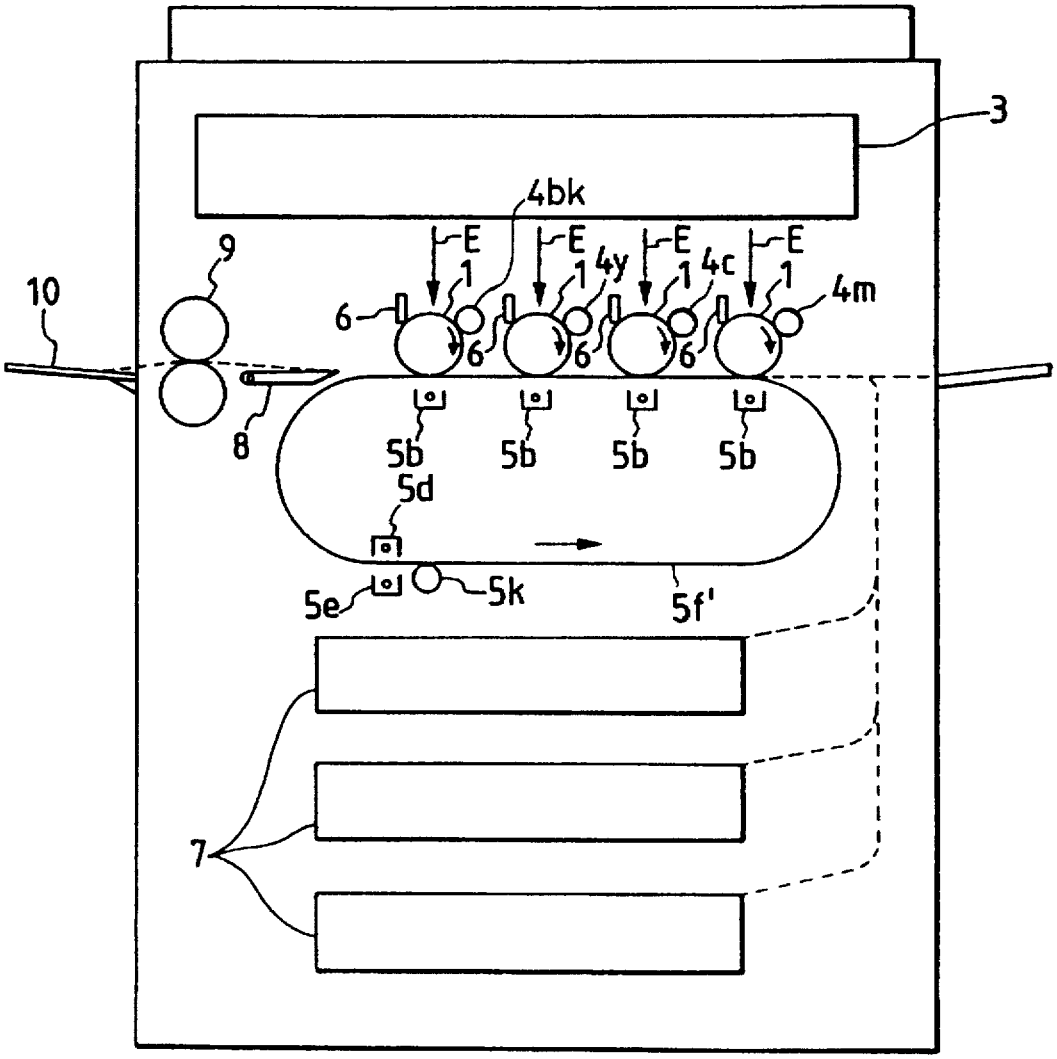
FIG. 13 is a schematic view of an image forming apparatus, constituting an embodiment 6 of the present invention.

In the following there will be explained, with reference to FIG. 13, an embodiment 6 of the image forming apparatus of the present invention. The image forming apparatus of this embodiment 6 is substantially similar, in structure, to the conventional color image forming apparatus explained with reference to FIG. 14, and equivalent components are represented by same numbers. In the color image forming apparatus of the present embodiment, a photosensitive drum 1, constituting the image bearing member, is supported so as to be rotatable in a direction indicated by an arrow, and a corona charger, an optical system 3, a developing unit 4, a transfer unit 5 and a cleaning unit 6 are positioned around the periphery of the photosensitive drum 1. The optical system 3 is comprised of an original scanning unit a color separation filters, and consists, for example, of a laser beam exposure unit for irradiating the photosensitive drum 1 with a color separated optical image or an equivalent optical image E.

The photosensitive drum 1, uniformly charged by the charger 2, is irradiated with the optical image E, for each separated color, to form an electrostatic latent image. The developing unit 4 of the fixed type is comprised of four developing units, namely a yellow developing unit 4*y*, a cyan developing unit 4*c*, a magenta developing unit 4*m* and a black developing unit 4*bk*, positioned along the periphery of the photosensitive drum 1. The latent image on the photosensitive drum 1 is developed by the developing unit, whereby a visible image is formed on the drum 1 with toner principally composed of resin.

The toner image on the photosensitive drum 1 is transferred onto a recording material, which is supplied from a recording material cassette 7, through a transport system and a transfer unit 5 (along a broken-lined sheet path), to a position opposed to the photosensitive drum 1. The transfer unit 5 of this embodiment is provided with a recording material supporting sheet 5*f*, a transfer corona charger 5*b* and an internal corona charger 5*d*. Along with the rotation of the recording material supporting sheet 5*f* in the direction indicated by an arrow, the toner image on the photosensitive drum 1 is transferred onto the recording material supported on the recording material supporting sheet 5*f*. Color images of a desired number are thus transferred on the recording material, transported by attraction on the recording material supporting sheet 5*f*, whereby a full-color image is obtained.

After the transfer of the toner images of a desired number in this manner, the recording material is separated from the transfer drum 5*a* by separating means 8 and is discharged, through a heat roller fixing unit 9, to a tray 10. After the image transfer, the photosensitive drum 1 of the toted to the cleaning of the toner remaining on the surface by the cleaning unit 6, and is then used again for image formation.

As shown in FIG. 14, the polishing means 5*k* is provided at the downstream side of the external corona charger 5*e*, with respect to the rotating direction of the recording material supporting sheet 5*f*. The polishing means 5*k* may be comprised of a polishing roller, a fur brush or a rocking polishing member as disclosed in the foregoing embodiments.

Also in the image forming apparatus of the present embodiment, the presence of the polishing means for polishing the recording material supporting sheet allows to prevent the loss in the attractive force of the recording material supporting sheet on the recording material, thereby avoiding the drawbacks such as sheet jamming.

[Embodiment 7]

Figure 17:
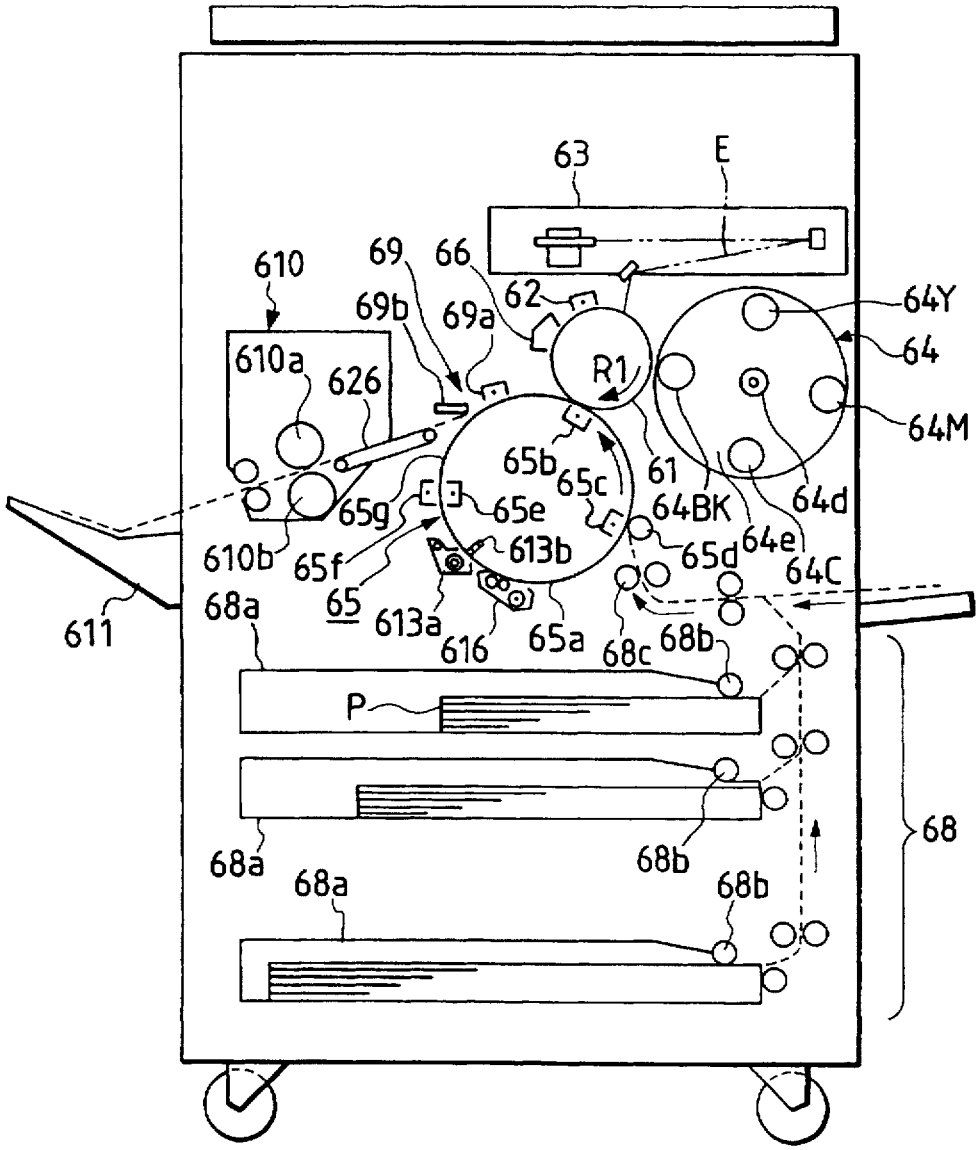
FIG. 17 is a longitudinal cross-sectional view of a full color image forming apparatus equipped with the coil cleaning device of the embodiment 7.

FIG. 17 schematically shows the structure of a full (four) color image forming apparatus of the present embodiment.

At the approximate center of the apparatus, there is provided a photosensitive drum 61, serving as the image bearing member. The photosensitive drum 61 is rendered rotatable in a direction R1, and a primary charger 62, exposure means 63, a developing unit 64, a transfer unit 65 and a cleaning unit 66 are provided in the order along the rotating direction, around the periphery of the photosensitive drum 61. Below the transfer unit 65, there is provided a feed unit 68 for the recording material P. The feed unit 68 is provided with plural sheet cassettes 68*a* for accommodating recording materials P of respectively different sizes, sheet feed rollers 68*b* for feeding the recording material P from the cassettes 68*a*, and registration rollers 68*c*, and forms sheet transport paths, indicated by broken lines in FIG. 17. At the downstream side of the transfer unit 65, there are provided separation means 69, a fixing unit 610 and a sheet discharge unit 611.

In the following there will be explained the function of the above-explained image forming apparatus, with description of the additional configurations.

The photosensitive drum 61, rotated in the direction R1 by drive means (not shown), is surfacially charged uniformly by the primary charger 62. The exposure means 63, containing an original scanning unit and color separation filters, effects irradiation of a color separated optical image E or an equivalent optical image. The exposure means 63 can be comprised, for example, of a laser beam exposure unit, which irradiates the uniformly charged surface of the photosensitive drum 61 with an optical image E of each separated color (for example optical image of yellow color), thereby dissipating the charge in the irradiated areas and forming an electrostatic latent image, which is then rendered visible by the developing unit 64. The developing unit 64 is provided with a rotary support member 64*e* rotated about a central axis 64*d*, and four developing units 64Y, 64M, 64C and 64Bk, respectively containing toners of yellow, magenta, cyan and black colors and mounted on the rotary support member 64*e*. The yellow developing unit 64Y, to be used in the image development is moved to a developing position opposed to the surface of the photosensitive drum 61 by the rotation of the rotary support member 64*e*, and yellow toner is deposited from a developing sleeve onto the electrostatic latent image present on the photosensitive drum 61, thereby forming a toner image.

The yellow toner image is transferred onto the recording material P supplied from the feed unit 68 to the transfer unit 65. The feed unit 68 is provided with plural sheet cassettes 68*a* for stacking the recording materials P of respectively different sizes, and a desired recording material P is supplied to the transfer unit 65 at a predetermined timing, through a feed roller 68*b*, plural transport rollers and registration rollers 68*c*. The transfer unit 65 is provided with a transfer drum 65*a*, a transfer charger 65*b*, an attraction charger 65*c* for electrostatically attracting the recording material P, an attraction roller 65*d* opposed thereto, an internal charger 65*e* and an external charger 65*f*, and the transfer drum 65*a*, rotated in a direction R5, is provided, on the peripheral aperture area thereof, with an integrally cylindrical recording material supporting sheet 65*g* composed of a dielectric material. Across the recording material supporting sheet 65*g*, there are provided a transfer cleaner 613*a* and a back-up brush 613*b* in mutually opposed manner. Also an oil cleaning unit 616 is provided at the downstream side of said transfer cleaner 613*a*, along the surface of the transfer drum 65. The recording material P, supplied from the feed unit 68, is supported by attraction on the surface of the transfer drum 65 and rotates in the direction R5 together with the rotation of the transfer drum 65*a*, whereupon the yellow toner image is transferred from the photosensitive drum 61 by the function of the transfer charger 65*b*. After the toner image transfer, the photosensitive drum 61 is subjected to the removal of toner remaining on the surface thereof and is used again for the next image formation.

The transfer of the yellow toner image to the recording material P is completed in this manner. A similar image forming process is repeated for each of other magenta, cyan and black colors, whereby the toner images of four colors are transferred on the recording material P supported on the transfer drum 5*a*.

After the transfer of the toner images of four colors, the recording material P is separated from the transfer drum 65*a* by a separating charger 69*a* and a separating finger 69*b* of the separation means 69, and is transported, while bearing unfixed (electrostatically deposited) toner images thereon, by a conveyor belt 626 to the fixing unit 610. On the other hand, the transfer drum 65*a*, from which the recording material P is removed, is subjected to the removal of the surfacially remaining unnecessary toner by the transfer cleaner 613*a*, and is used for the supporting of the next recording material P.

The fixing unit 610 is provided with a fixing roller 610*a* incorporating a heater, and a pressure roller 610*b* positioned thereunder and maintained in pressure contact therewith, and said rollers 610*a*, 610*b* heat and pressurize the recording material P while pinching and transporting said recording material P in the nip portion of said rollers, thereby fixing the toner images by fusion. The recording material P after fixation is discharged onto a tray 611, whereby completed in the formation of a full (four) color image.

Oil is applied to the surface of the fixing roller 601*a* as explained before, so that, at the fixing operation, the oil is transferred though in a slight amount, also onto the recording material P. Consequently, in case of effecting image formation on the second face of such recording material P, with its first face bearing thus transferred oil and maintained now in contact with the surface of the transfer drum 65*a*, the oil is also deposited onto said surface of the transfer drum 65*a*.

Consequently, after the image transfer onto the second face of the recording material bearing the fixed images on the first face thereof, the transfer drum 65*a* no longer bearing the recording material P is subjected to the removal of remaining unnecessary toner by the transfer cleaner 613*a* and to the removal of deposited unnecessary oil by the oil cleaning unit 616.

Figure 15:
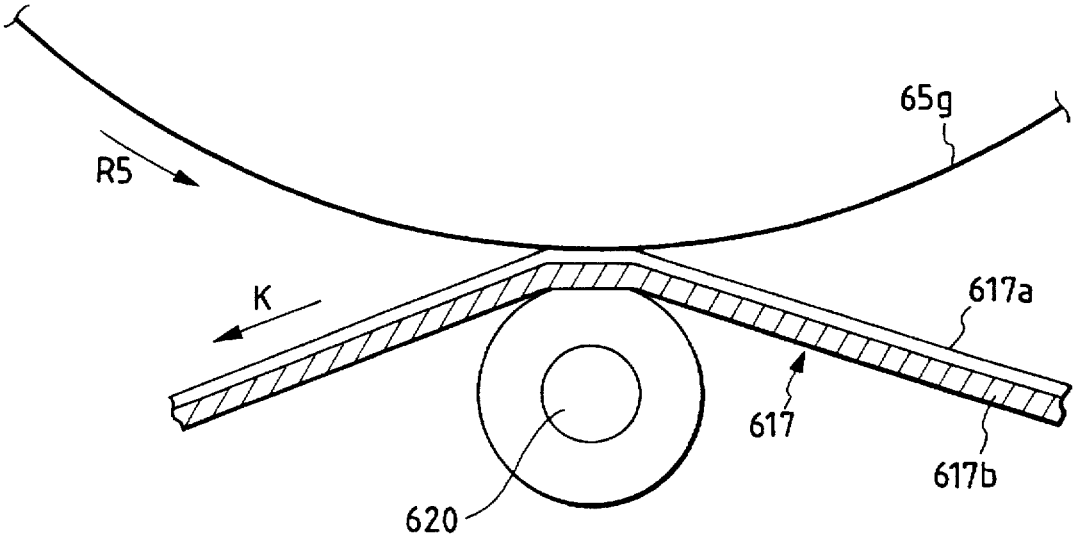
FIG. 15 is a magnified cross-sectional view of an oil cleaning member in an embodiment 7.
Figure 16:
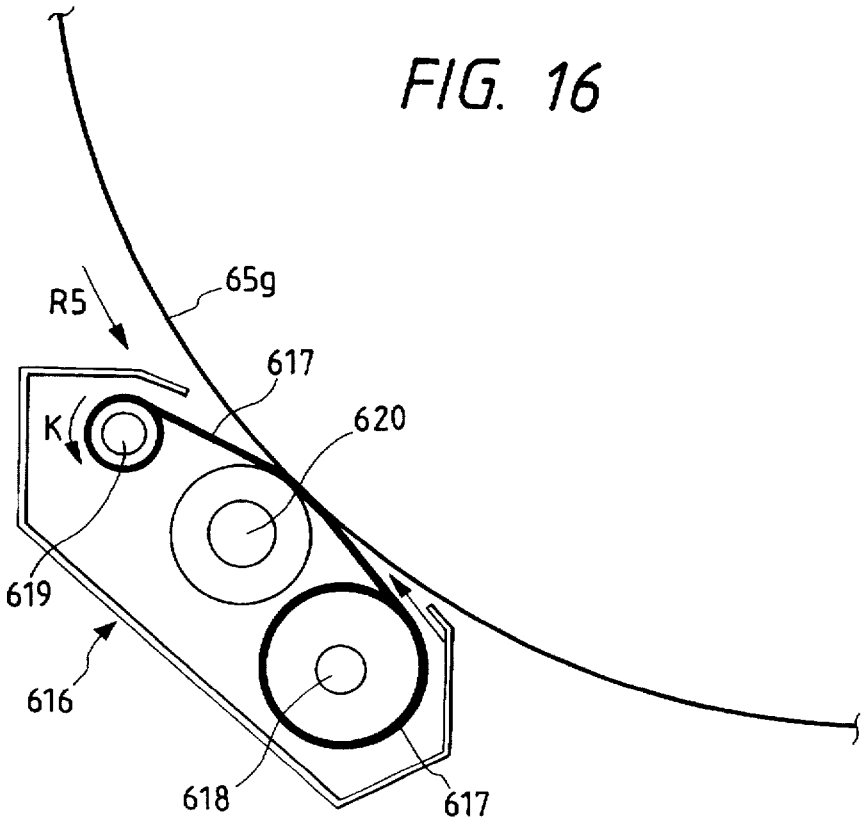
FIG. 16 is a longitudinal cross-sectional view of an oil cleaning device in the embodiment 7.

FIG. 15 is a magnified cross-sectional view of an oil cleaning member 617 of the present embodiment, and FIG. 16 is a longitudinal cross-sectional view of the oil cleaning unit 616 including the oil cleaning member 617.

In the oil cleaning unit 616 shown in FIG. 16, a non-woven cloth 617 serving as the oil cleaning member is wound as a web around a core 618 is gradually unwound from the core 618 and is taken up on another core 619 which is rotated in a direction K. Between the cores 618 and 619, the non-woven cloth 617 is pressed from the rear face side thereof, by a core 620 bearing a surfacial sponge layer thereon, toward the surface of the recording material supporting sheet 65*g*, whereby the non-woven cloth 617 rubs the surface of the recording material supporting sheet 65*g* and wipes off the oil deposited thereon.

The entire oil cleaning unit 616 is rendered rotatable about an axis (not shown), whereby the non-woven cloth 617 can be maintained in contact with or separated from the recording material supporting sheet 65*g*. The cleaning operation is preferably conducted within a same turn of the recording material supporting sheet 65*g* as that of the separation of the recording material P, namely before a surface area of the recording material supporting sheet 65*g*, which has been in contact with the rear face of the recording material P comes into contact with the surface of the photosensitive drum 61. In this manner there can be prevented the transfer of the oil, which has been transferred from the recording material P to the surface of the recording material supporting sheet 65*g*, to the surface of the photosensitive drum 61.

As shown in FIG. 15, the non-woven cloth 617 is comprised of an oil removing layer (surface layer) 617*a* and an oil absorbing layer (inner layer) 617*b*, positioned opposite to the member to be cleaned. In the cleaning operation, the oil removing layer 617*a* is maintained in contact with the member to be cleaned. In case the non-woven cloth 617 is composed solely of the oil removing layer 617*a*, the oil removed at the surface of said layer diffuses to the interior thereof, but the oil density becomes same at the surface and at the interior, because the non-woven cloth is comprised of a single member, so that the oil removing ability at the surface becomes limited. For this reason it becomes necessary to advance the non-woven cloth 617 at least with a certain speed, in order to bring a new portion of the oil removing layer 617*a* into contact with the surface of the recording material supporting sheet 65*g* in succession, so that the running cost becomes inevitably high.

In the present embodiment, therefore, the nonwoven cloth 617 is comprised of the oil removing layer 617*a* and the oil absorbing layer 617*b* of mutually different materials, in such a manner that the oil absorbing layer 617*b* has higher oleophilicity than in the oil removing layer 617*a*. Thus the oil removed at the surface of the oil removing layer 617*a* and diffusing into the interior thereof further diffuses into the oil absorbing layer 617*b* and does not return to the oil removing layer 617*a*, because of the higher oleophilicity of the oil absorbing layer 617*b*. Stated differently, the oil absorbing layer 617*b* has a stronger oil retaining ability, and, for this reason, the oil density in the oil removing layer 617*a* becomes lower, so that the life of the oil removing ability can be extended.

In the present embodiment, the non-woven cloth 617 is comprised of the following materials:

Oil removing layer 617*a*

Fiber material: nylon-polyester composite fibers

Fiber thickness: 4 μm in average

Density of non-woven cloth: 0.170 g/cm$^3$

Thickness of non-woven cloth: 500 μm

Oil absorbing layer 617*b*

Fiber material: polypropylene

Fiber thickness: 3.5 μm in average

Density of non-woven cloth: 0.267 g/cm$^3$

Thickness of non-woven cloth: 300 μm

As regards the material of the fibers constituting the non-woven cloth 617, there have been investigated polypropylene, polyester, nylon, acrylic resin, vinylon and composite fibers in addition to the material employed in the present embodiment, and the effect of the present invention has been attained by selecting higher oleophilicity in the oil absorbing layer 617*b* than in the oil removing layer 617*a*. Among these materials, the oleophilicity descends in the above-mentioned order and is highest in polypropylene, because it contains an oleophilic radical of strongest oleophilicity ($CH_3CHCH_2$—).

Also these materials have been tried as woven or knit fabric instead of non-woven cloth, but such fabric causes uneven oil wiping along the direction of weaving or knitting and has an undesirably narrow range of setting as the oil cleaning member.

[Embodiment 8]

The effect of the present invention can be more effectively exploited by further increasing the oil retaining ability of the oil absorbing layer 617*b*.

The oil cleaning member 617 of the present embodiment is composed of two layers, namely an oil removing layer 617*a* and an oil absorbing layer 617*b*, as in the embodiment 7, with the same materials as therein, but, in the present embodiment the fiber density is selected lower in the oil absorbing layer 617*b* than in the oil removing layer 617*a*. More specifically, the oil removing layer 617*a* is comprised of nylon non-woven cloth of a density of 0.170 g/cm$^3$, while the oil absorbing layer 617*b* is comprised of polypropylene non-woven cloth of 0.10 g/cm$^3$. A lower density in the non-woven cloth signifies wider spaces available for oil retention, among the fibers, so that the oil retaining ability becomes higher at a lower density.

In this manner the oil removed by the oil removing layer 617*a* can be more easily retained in the oil absorbing layer 617*b*, so that the oil can be more effectively removed.

[Embodiment 9]

The oil cleaning member 617 in the foregoing embodiments is formed as a web, but it is also possible to form it as a roller for example by spirally winding a cloth or a fabric. Such roller-shaped member allows to simplify the configuration of the cleaning unit and to lower the running cost, in comparison with the web-shaped member.

Figure 18:
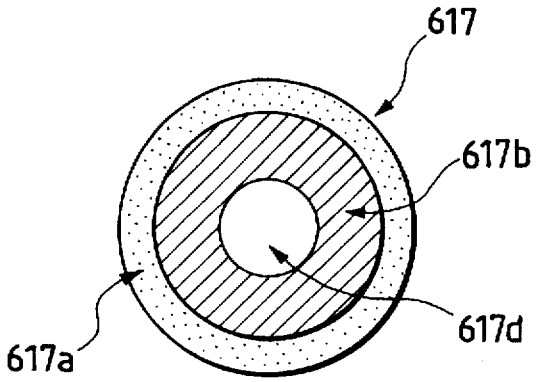
FIG. 18 is a longitudinal cross-sectional view of a cleaning roller in an embodiment 9.

A roller-shaped oil cleaning member 617 shown in FIG. 18 (hereinafter also called a cleaning roller) is composed of a core 617*d*, an oil absorbing layer 617*b* wound therearound and consisting of a polypropylene layer of high oleophilicity, and an oil removing layer 617*a* consisting of a single layer of nylon non-woven cloth.

Figure 19:
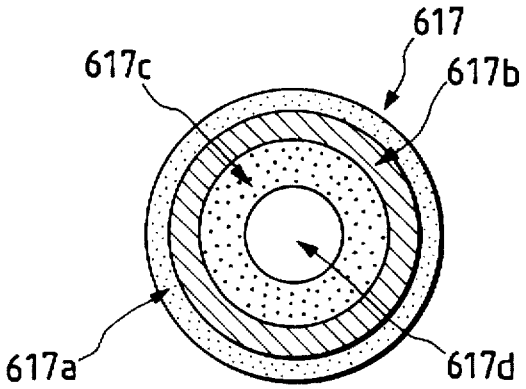
FIG. 19 is a longitudinal cross-sectional view of another cleaning roller in the embodiment 9.

Also a cleaning roller 617 shown in FIG. 19 is comprised of a core 617*d*, a sponge layer 617*c* wound therearound, an oil absorbing layer 617*b* wound therearound and consisting of a polypropylene layer of high oleophilicity, and an oil removing layer 617*a* consisting of nylon non-woven cloth wound thereon. Presence of such sponge layer 617*c* increases the width of the nip when the cleaning roller 617 is brought into contact with the recording material supporting sheet 65*g*, thereby further improving the cleaning ability.

In this embodiment 9, a cleaning roller 617 of the type shown in FIG. 19 with an external diameter of 20.0 mm is used for cleaning the oil present on the recording material supporting sheet 65*g* of a moving speed of 133 mm/sec, and the oil on the recording material supporting sheet 65*g* can be almost completely removed by moving said cleaning roller with a relative moving speed of 65 to 95%, preferably about 80%, or of 105 to 150%, preferably about 120%, of said moving speed of the recording material supporting sheet 65*g*.

Also the rotating direction of the cleaning roller 617 has been investigated in the following manner. When it is rotated in the opposite direction to the recording material supporting sheet 65*g* (moving direction of the surface of the recording material supporting sheet 65*g* being opposite to that of the surface of the cleaning roller 617), the weight of the removed oil is substantially same as that in case of rotation in the same direction, but there can be observed certain wiping streaks in the rotating direction, in the observation of the surface of the recording material supporting sheet 65*g* under a microscope. Thus the rotating direction of the cleaning roller 617 does not affect the removal of the transferred oil, but the experimental observation indicates that the cleaning roller 617 is preferably so rotated that the surface thereof moves in a same direction as the moving direction of the recording material supporting sheet 65*g*.

[Embodiment 10]

In the embodiments 6 to 8 explained above, a web-shaped oil cleaning member 617 or a cleaning roller 617 is employed, in a full color image forming apparatus provided with so-called transfer drum 65*a*, as a member for removing the oil from the recording material supporting sheet 65*g* of the transfer drum 65*a*, but it is also possible to remove the unnecessary oil directly from the recording material P by positioning for example a cleaning roller 617 in the recording material transport unit.

Figure 20:
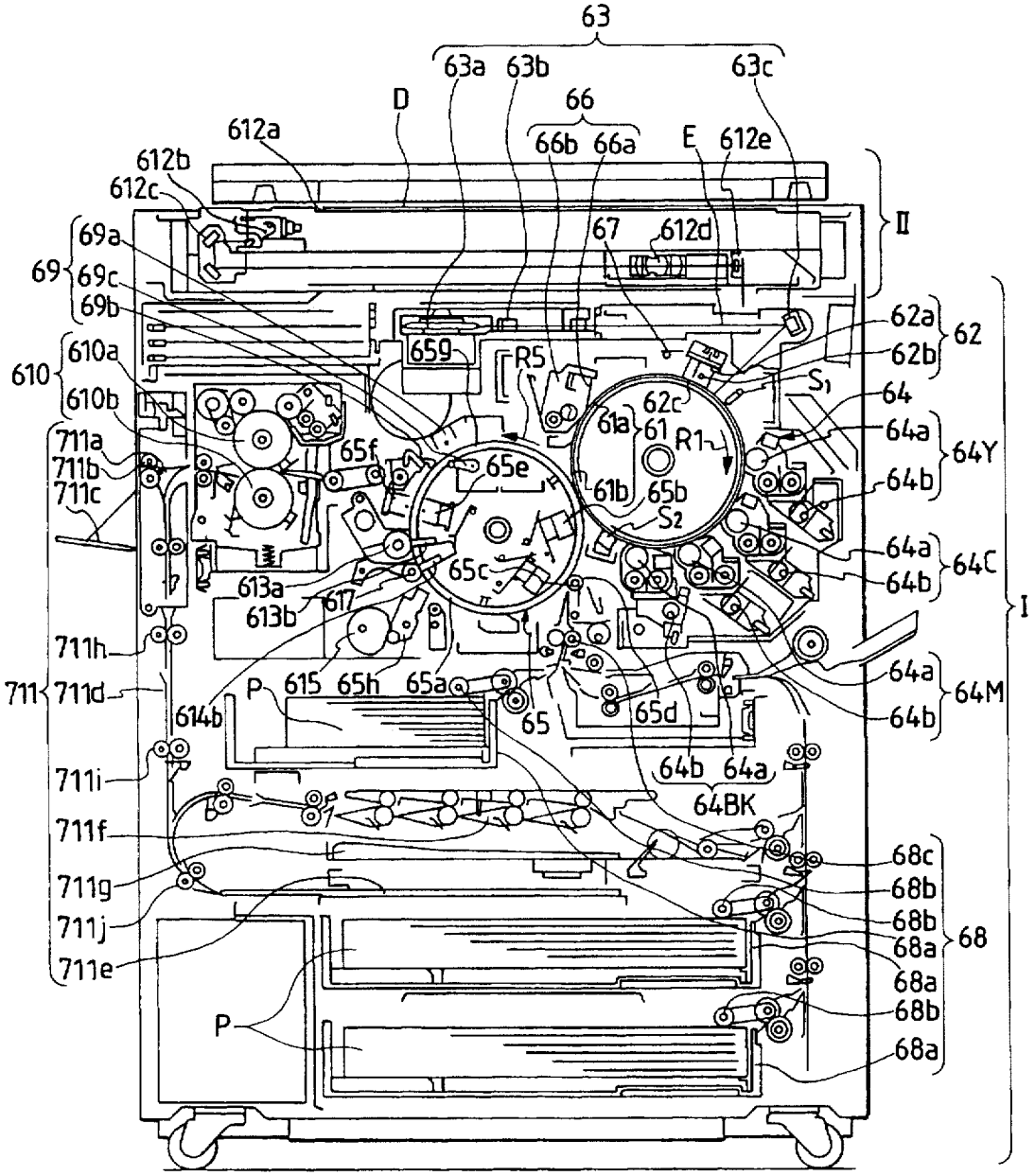
FIG. 20 is a longitudinal cross-sectional view of a full color image forming apparatus of an embodiment 10.

FIG. 20 is a longitudinal cross-sectional view of a full color image forming apparatus to be explained in the following, equipped with a cleaning roller 617 for removing the oil present on the surface of the recording material supporting sheet 65*g* of the transfer drum 65, and cleaning rollers (illustrated as transport rollers 711*h*, 711*i*) positioned in the recording material transport unit for directly removing the oil from the recording material P. In FIG. 20, components the same as those in the color image forming apparatus of the embodiment 7 are represented by same numbers.

The image forming apparatus shown in FIG. 20 is composed of a digital color image printer unit I (hereinafter called printer) at the bottom and a digital color image reader unit II (hereinafter called reader) at the top, and an image is formed on the recording material P by the printer I, based on the image of an original D read by the reader II.

In the following there will be briefly explained the structure of the printer I and the reader II.

The printer I is provided with a photosensitive drum 61, serving as the image bearing member, to be rotated in a direction R1. Around the photosensitive drum 61 there are provided, in the order along the rotating direction thereof, a primary charger (charging means) 62, exposure means 63, a developing unit (developing means) 64, a transfer unit 65, a cleaning unit 66, a pre-exposure lamp 67 etc. Below the transfer unit 65, namely in the lower half of the printer I, there is provided a feed unit 68 for the recording material P. Also separation means 69 is provided above the transfer unit 65, and a fixing unit 610 and a discharge unit 711 are provided at the downstream side (with respect to the transporting direction of the recording material P) of the separation means 69.

The photosensitive drum 61 is comprised of an aluminum drum-shaped substrate 61*a*, and a photosensitive member 61*b* covering the surface thereof and comprised of an organic photoconductor (OPC), and is rotated by drive means (not shown) in a direction R1 with a predetermined process (peripheral) speed. The photosensitive drum 61 will be explained further in the following.

The primary charger 62 is a corona charger provided with a shield 62*a* having an aperture in a portion opposed to the photosensitive drum 61, a discharge wire 62*b* positioned inside the shield 62*a* parallel to the generatrix of the photosensitive drum 61, and a grid 62*c* positioned at the aperture of the shield 62*a* for limiting the charging potential. The primary charger 62 is given a charging bias by a power source (not shown), and uniformly charges the surface of the photosensitive drum 61 with predetermined polarity and potential.

The exposure means 63 is provided with a laser unit (not shown) for emitting a laser beam based on the image signal from the reader II to be explained later, a polygon mirror 63*a* for reflecting the laser beam, a lens 63*b*, and a mirror 63*c*. The exposure means 63 serves to irradiate the surface of the photosensitive drum 61 with said laser beam, thus effecting the exposure of the photosensitive drum 61 to dissipate the charge in the exposed area, thereby forming an electrostatic latent image. In the present embodiment, the original image is separated into yellow, cyan, magenta and black colors, and electrostatic latent images corresponding to these colors are formed in succession on the photosensitive drum 61.

The developing unit 64 is provided, in the order from the upstream side along the rotating direction (R1) of the photosensitive drum 61, with developing units 64Y, 64C, 64M, 64Bk respectively containing toners of yellow, cyan, magenta and black colors, principally comprised of a resinous material. Each of the developing units 64Y, 64C, 64M, 64Bk is provided with a developing sleeve 64*a* for depositing toner onto the electrostatic latent image formed on the photosensitive drum 64, and a developing unit of a color to be used in the development is selectively brought, by an eccentric cam 64*b*, to a developing position close to the surface of the photosensitive drum 61 to deposit the toner through the developing sleeve 64*a* to the latent image, thereby forming a visible toner image. In such developing operation, the developing units of other three colors are retracted from the developing positions.

The transfer unit 65 is provided with a transfer drum (recording material support member) 65*a* for supporting the recording material P on the periphery thereof, a transfer charger (transfer means) 65*b* for transferring the toner image from the photosensitive drum 61 to the recording material P, an attraction charger 65*c* for attracting the recording material P to the transfer drum 65*a*, an attraction roller 65*d* opposed thereto, an internal charger 65*e* and an external charger 65*f*, and the transfer drum 65*a*, supported rotatably in a direction R5, is provided, on the peripheral apertures thereof, with a cylindrical recording material supporting sheet 65*g* of a dielectric material, such as polycarbonate film. The transfer unit 65 is so constructed as to support, by attraction, the recording material P on the surface of the transfer drum 65*a*.

The cleaning unit 66 is provided with a cleaning blade 66*a* for scraping off the toner remaining on the photosensitive drum 61 without being transferred to the recording material P, and a cleaning container 66*b* for recovering the scraped toner. The pre-exposure lamp 67 is provided adjacent to and at the upstream side of the primary charger 62, and serves to eliminate the unnecessary charge on the photosensitive drum 61 after the cleaning by the cleaning unit 66.

The feed unit 68 is provided with plural sheet cassettes 68*a* for stacking recording materials P of respectively different sizes, feed rollers 68*b* for feeding the recording material P from said cassettes 68*a*, plural transport rollers and registration rollers 68*c*, and serves to supply the transfer drum 65*a* with the recording material P of a desired size. The separation means 69 is provided with a separation charger 69*a* for separating the recording material P, after the toner image transfer, from the transfer drum 65*a*, a separating finder 69*b*, a separation roller 69*c* etc. The fixing unit 610 is provided with a fixing roller 610*a* incorporating a heater therein, and a pressure roller 610*b* positioned under the fixing roller 610*a* and serving to press the recording material P to the fixing roller 610*a*. The surface of the fixing roller 610*a* is coated with oil.

The discharge unit 711 is provided with a transport path switching guide 711*a* positioned at the downstream side of the fixing unit 610, discharge rollers 711*b*, a discharge tray 711*c*. Also below the transport path switching guide 711*a*, there are provided a vertical transport path 711*d*, an inversion path 711*e*, a stacking member 711*f*, an intermediate tray 711*g*, transport rollers 711*h*, 711*i*, an inversion roller 711*j* etc. for forming images on both sides of a recording material P.

Along the periphery of the photosensitive drum 61, a potential sensor S1 for detecting the surface potential thereof is provided between the primary charger 62 and the developing unit 64, and a density sensor S2 for detecting the density of the toner image on the photosensitive drum 61 is provided between the developing unit 64 and the transfer drum 65*a*.

In the following there will be given an explanation on the reader II. The reader II, positioned on the printer I, is provided with an original supporting glass 612*a* for supporting the original D, an exposure lamp 612*b* for scanning the image bearing face of the original D, plural mirrors 612*c* for reflecting the light reflected from the original D, a lens 612*d* for condensing the reflected light, a full-color sensor 612*e* for generating color separated image signals from the light coming from the lens 612*d* etc. The color separated image signals are amplified in an amplifier circuit (not shown), then processed in a video processing unit (not shown) and supplied to the printer I explained above.

In the following there will be explained the function of the above-explained image forming apparatus, with description of certain additional configurations. In the following description it is assumed that a four-color image is formed in the order of yellow, cyan, magenta and black.

The image of the original D, placed on the original supporting glass 612*a* of the reader II, is illuminated by the exposure lamp 612*b* and is separated in color, whereupon the yellow image is at first read by the full-color sensor 612*e*, and supplied, after predetermined processes, to the printer I as image signals.

In the printer I, the photosensitive drum 61 is rotated in the direction R1 and is surfacially charged uniformly by the primary charger 62. Based on image signals supplied from the reader II explained above, the laser unit of the exposure means 62 emits a laser beam, thereby exposing, by means of the polygon mirror 63*a* etc. the charged surface of the photosensitive drum 61 to the optical image E to dissipate the charge in the exposed area, thereby forming an electrostatic latent image corresponding to yellow color. In the developing unit 64, the yellow developing unit 64Y is brought to the predetermined developing position, while other developing units 64C, 64M, 64Bk are retracted from the developing positions. The electrostatic latent image on the photosensitive drum 61 is rendered visible as a yellow toner image, by the deposition of yellow toner by the developing unit 64Y. The yellow toner image on the photosensitive drum 61 is transferred onto the recording material P supported on the transfer drum 65*a*. The recording material P, of a size matching the original image, has been supplied to the transfer drum 65*a* at a predetermined timing, from a suitable cassette 68*a* through the feed roller 68*b*, transport rollers and registration roller 68*c*. The recording material P thus supplied is wound by electrostatic attraction on the surface of the transfer drum 65*a* and is rotated in the direction R5, whereupon the yellow toner image on the photosensitive drum 61 is transferred by the function of the transfer charger 65*b*.

On the other hand, the photosensitive drum 61 after the toner image transfer is subjected to the removal of the remaining toner by the cleaning unit 66, then to the removal of the unnecessary charge by the pre-exposure lamp 67, and is used for the next image formation starting from the primary charging step.

The above-explained processes from the original image reading by the reader II, through the toner image transfer onto the recording material P on the transfer drum 65*a*, to the cleaning and charge elimination of the photosensitive drum 61 are similarly repeated for other cyan, magenta and black colors, whereby toner images of four colors are superposedly transferred onto the recording material P present on the transfer drum 65*a*.

The recording material P, subjected to the transfer of toner images of four colors, is separated from the transfer drum 65*a* by means of the separation charger 69*a* and the separating finger 69*b*, and is transported, while bearing the unfixed toner images thereon, to the fixing unit 610. The recording material P is pressed under heating, by the fixing roller 610*a* and the pressure roller 610*b* of the fixing unit 610, whereby the toner images on the surface are fixed by fusion. The recording material P after image fixation is discharged by the discharge rollers 711*b* onto the tray 711*c*.

In case of forming images on both sides of the recording material P, the transport path switching guide 711*a* is shifted to guide the recording material P, emerging from the fixing unit 610, through the vertical transport path 711*d*, to the inverting path 711*e*. Then the inversion roller 711*j* is reversed to advance the recording material P in a direction opposite to the original advancing direction, with the trailing end of the recording material P as the new leading end, to the intermediate tray 711*g*. Subsequently an image is formed on the other face by the above-explained image forming process, and the recording material P is discharged onto the tray 711*c*.

In this embodiment, rollers similar to the cleaning roller 617 of the present invention are employed in the transport rollers 711*h*, 711*j* in the vertical transport path 711*d*. As the oil can be removed in this manner from the recording material P immediately after image fixation, so that the recording material supporting sheet 65*g* can be almost completely prevented from oil deposition.

Also the oil eventually deposited on the recording material supporting sheet 65*g* can be removed by the cleaning roller 617. After the separation of the recording material P, the transfer drum 65*a* is cleaned by the transfer cleaner 613*a* and the back-up brush 613*b* positioned in mutually opposed manner across the recording material supporting sheet 65*g* and the aforementioned cleaning (oil removing) roller 617 and the back-up brush 614*b* positioned in a similar manner, in order to remove the dusts deposited by scattering and the oil deposited from the recording material P. Such cleaning is conducted before or after the image formation, and also in case of sheet jamming.

In the present embodiment, the gap between the recording material supporting sheet 65*g* and the photosensitive drum 61 is made arbitrarily selectable by the activation, at a desired timing, of an eccentric cam 615, which drives a cam follower 65*h* integral with the transfer drum 65*a*. For example, in the stand-by state or in a state where the power supply is turned off, the gap between the transfer drum 65*a* and the photosensitive drum 61 is made larger, since the charge eventually present on the transfer drum 65*a* induces a charge memory phenomenon on the photosensitive drum 61, thereby deteriorating the image quality in the subsequent image formation.

As explained in the foregoing, the present embodiment can reduce the amount of oil transferred to the transfer drum 65*a*, since the oil deposited onto the recording material P in the image formation on the first face is directly removed by the oil removing rollers 711*h*, 711*i*.

[Embodiment 11]

Figure 21:
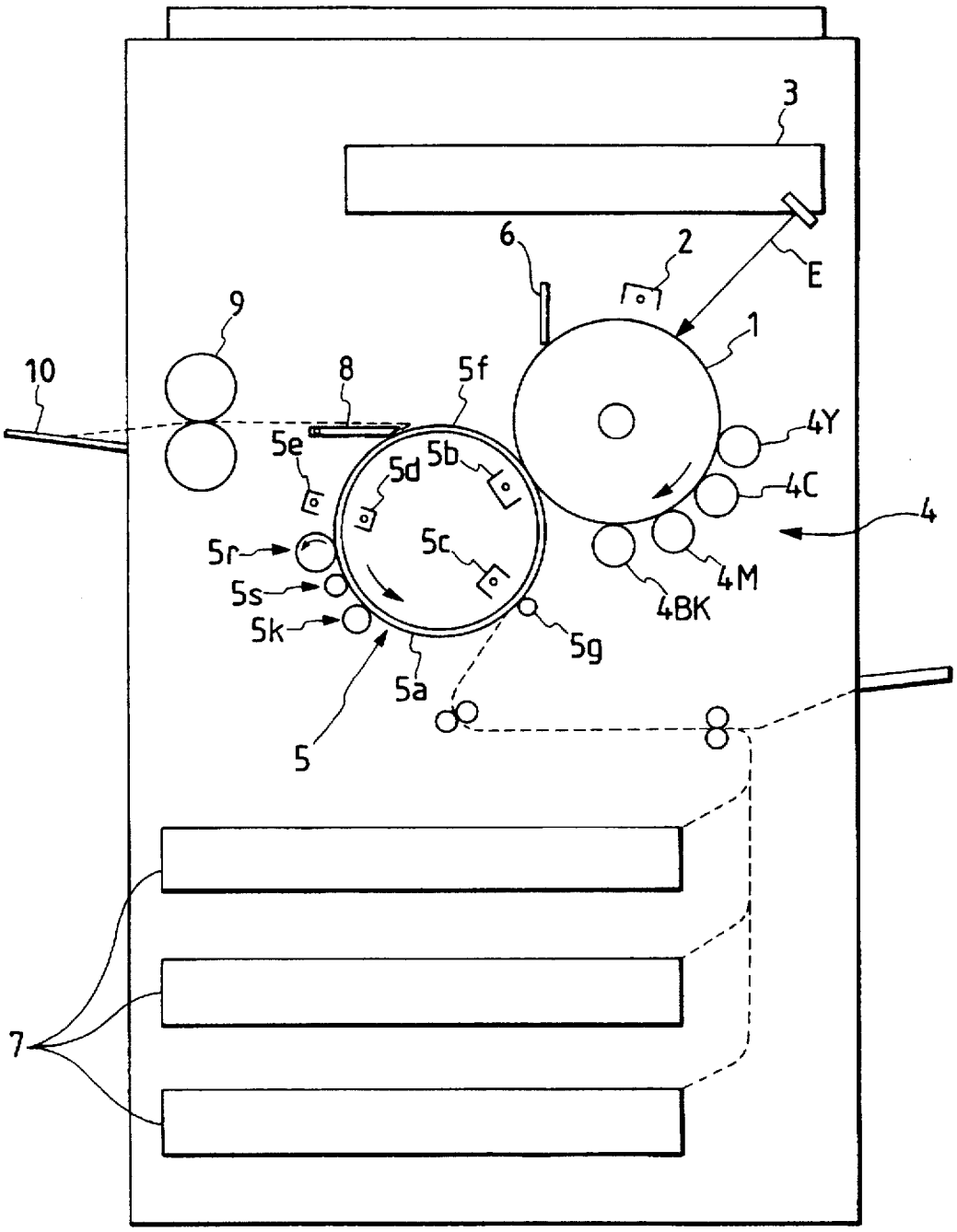
FIG. 21 is a longitudinal cross-sectional view of a full color image forming apparatus of an embodiment 11.

In the following there will be explained an embodiment 11 of the present invention with reference to FIG. 21, which is a schematic longitudinal cross-sectional view of the color image forming apparatus of the present embodiment. It is substantially similar, in structure, to the apparatus of the embodiment 1 shown in FIG. 1, but is different in that a fur brush 5*r* is provided for removing the unnecessary toner deposited onto the transfer drum 65*a*, and that an oil removing roller 5*s* is provided for removing the oil deposited onto the transfer drum 65*a*.

The fur brush employed in the present embodiment is comprised of rayon fibers with a density of 20,000 fibers per inch. The fur brush 5*r* is rotated in a direction indicated by an arrow and with a revolution of 1500 rpm, by a motor (not shown), and is brought into contact with the recording material supporting sheet 5*f* by the activation of an eccentric cam (not shown).

The oil removing roller 5*s* is similar to the oil cleaning member 617 of the embodiment 9. It may also be replaced by the web-shaped oil leaning member 617 described in the embodiment 7 or 8. In the fixing unit 9, oil coating is conducted for improving the releasing of the recording material from the fixing unit, so that the oil is deposited onto the recording material at the passage thereof through the fixing unit.

In case of forming again an image on the rear face of a recording material which has already been subjected to image formation and has therefore passed the fixing unit, the oil deposited thereon is transferred to the recording material supporting sheet 5*f*. The above-mentioned oil removing roller 5*s* is necessitated because a satisfactory image cannot be obtained if such oil on the recording material supporting sheet is further transferred to the photosensitive drum 1.

The toner, oil and paper dusts deposited on the transfer drum 5*a* are removed in the following manner.

At first the toner deposited on the transfer drum 5*a* is removed by the fur brush 5*r*. Then, after the removal of the unnecessary toner, the transfer drum 5*a* is subjected to the removal of deposited oil, by the oil removing roller 5*s*, positioned at the downstream side, in the moving direction of said transfer drum 5*a*, with respect to the fur brush 5*s* and the separating position where the recording material is separated from the transfer drum 5*a* by the separation means 8.

A polishing operation by the polishing roller 5*k* is conducted after the removal of toner and oil deposited onto the transfer drum, as explained above. In this operation, the fur brush 5*r* is operated in contact with the transfer drum 5*a*, in order to collect the dusts generated by the polishing operation. The oil removing roller 5*s* is positioned at the downstream side of the fur brush 5*r* as explained before, because the oil removing ability of the oil removing roller is deteriorated if it is contaminated with the dusts. Preferably the oil removing roller 5*s* is separated from the transfer drum 5*a* during the polishing operation, in order to avoid contamination.

In the present embodiment, the fur brush 5*r*, oil removing roller 5*s* and polishing roller 5*k* are arranged in this order in the moving direction of the transfer drum 5*a* with respect to the separating position, as shown in FIG. 20, but it is preferable to position the components in the order of the polishing roller 5*k*, fur brush 5*r* and oil removing roller 5*s* in the moving direction of the transfer drum 5*a*, with respect to the separating position, for the purpose of reducing the distance from the generation of dust in the polishing operation to the collection of the dust by the fur brush 5r, thereby preventing the contamination of the interior of the apparatus with the dust.

The above-explained configuration of the polishing roller 5k, the fur brush 5r and the oil removing roller 5s allows to satisfactorily remove the unnecessary toner, oil and dust from the transfer drum 5a.

What is claimed is:

1. An image forming apparatus, comprising:

a recording material supporting member for supporting and transporting a recording material;

image forming means for forming an image on the recording material supported by said recording material supporting member;

polishing means, having polishing particles provided on a surface thereof and a holding portion for holding said polishing particles, for polishing said recording material supporting member; and memory means for memorizing a number of the recording materials subjected to image formation, wherein said polishing means polishes said recording material supporting member when the number memorized by said memory means reaches a predetermined value.

2. An image forming apparatus according to claim 1, wherein said polishing particles are alumina particles.

3. An image forming apparatus according to claim 1, wherein the recording material supported by said recording material supporting member is comprised of paper, and said polishing means is adapted to remove paper dust deposited on said recording material supporting member.

4. An image forming apparatus according to claim 1, wherein said recording material supporting member is adapted to support said recording material by electrostatic force.

5. An image forming apparatus according to claim 4, further comprising an image bearing member for bearing an image and transfer means for transferring the image of said image bearing member, at a transfer position, to the recording material supported by said recording material supporting member, wherein the radius X of curvature of said recording material supporting member at said transfer position and the radius Y of curvature of said image bearing member at said transfer position satisfy a relationship $Y \geqq X/2$.

6. An image forming apparatus according to claim 5, wherein satisfied preferably is a relationship $Y \geqq X/1.1$.

7. An image forming apparatus according to claim 4, wherein said recording material supporting member has a sheet-like shape.

8. An image forming apparatus according to claim 1, further comprising:

power supply means; and memory means for memorizing the number of the recording materials subjected to image formation, wherein said polishing means is adapted to polish said recording material supporting member when said power supply means of said apparatus is turned on from a turned-off state, while the number memorized by said memory means is within a predetermined range.

9. An image forming apparatus according to claim 1, further comprising power supply means, wherein said polishing means is adapted to polish said recording material supporting member when said power supply means of said apparatus is turned on from a turned-off state while the number memorized by said memory means is within a predetermined range smaller than the predetermined value.

10. An image forming apparatus according to one of claims 1, 8 and 9, further comprising detection means for detecting the temperature and humidity, wherein a polishing operation of said polishing means is controlled according to a result of detection by said detection means.

11. An image forming apparatus according to claim 10, wherein an absolute moisture amount is calculated from the result of detection of said detection means, and a polishing operation of said polishing means is inhibited when the absolute moisture amount is less than a predetermined value.

12. An image forming apparatus according to claim 1, further comprising cleaning means for cleaning said recording material supporting member after a polishing operation by said polishing means.

13. An image forming apparatus according to claim 12, further comprising an oil cleaning member for cleaning oil deposited on said recording material supporting member, wherein said oil cleaning member is adapted to effect the oil cleaning operation prior to the polishing operation of said polishing means.

14. An image forming apparatus according to claim 13, wherein said cleaning means is adapted to clean said recording material supporting member, prior to the oil cleaning operation by said oil cleaning member.

15. An image forming apparatus according to claim 13, wherein said oil cleaning member includes a surface layer for absorbing oil by contacting said recording material supporting member, and an internal layer positioned opposite to said recording material supporting member, with respect to said surface layer and adapted to absorb the oil, wherein the material of said internal layer is different from that of said surface layer and has a higher oleophilicity than that of said surface layer.

16. An image forming apparatus according to claim 13, wherein said oil cleaning member is separated from said recording material supporting member during the polishing operation by said polishing means.

17. An image forming apparatus according to claim 13, wherein said polishing means, said cleaning means and said oil cleaning member are arranged in this order, along the moving direction of said recording material supporting member, with respect to a separating position where the recording material is separated from said recording material supporting member.

18. An image forming apparatus according to claim 12, wherein said cleaning means is comprised of a brush.

19. An image forming apparatus according to claim 1, further comprising fixing means for fixing the image formed on the recording material.

20. An image forming apparatus according to claim 19, wherein said fixing means includes a pair of rotary members, and oil is applied to a rotary member at the side coming into contact with the unfixed image.

21. An image forming apparatus according to claim 20, wherein said recording material supporting member is adapted to support the recording material by contacting a first face of said recording material which bears, on said first face, an image fixed by said fixing means, and said image forming means is adapted to form an image on a second face of said recording material.

22. An image forming apparatus according to claim 1, wherein a polishing operation of said polishing means is determined based on a number of recording materials on which an image has been formed.

23. An oil cleaning member formed as a roller and adapted to be in contact with a member to be cleaned for cleaning oil deposited on the member to be cleaned, said oil cleaning member comprising:

a surface layer for absorbing oil by contacting the member to be cleaned;

an internal layer disposed inside said surface layer and adapted for absorbing oil; and a sponge layer disposed inside said internal layer, wherein a material of said internal layer is different from a material of said surface layer and has a higher oleophilicity than an oleophilicity of said material of said surface layer.

24. An oil cleaning member according to claim 23, wherein said surface layer is composed of non-woven cloth.

25. An oil cleaning member according to claim 23, wherein said internal layer has a weight per unit volume smaller than that of said surface layer.

26. An oil cleaning member according to claim 23, wherein said oil cleaning member has web-like shape.

27. An oil cleaning member according to claim 23, wherein said oil cleaning member cleans oil deposited on a recording material supporting member for supporting and transporting a recording material.

28. An oil cleaning member according to claim 23, wherein said surface layer is adapted to move in a direction same as the moving direction of said member to be cleaned.

29. An oil cleaning member according to claim 28, wherein said surface layer is moved with a speed within a range from 65 to 95% or from 105 to 150% of the moving speed of said member to be cleaned.

30. An oil cleaning member according to claim 23, wherein said oil cleaning member transports a recording material.

31. An image forming apparatus, comprising:

a recording material supporting member for supporting and transporting a recording material;

image forming means for forming an image on the recording material supported by said recording material supporting member; and an oil cleaning member including a surface layer for absorbing oil by contacting said recording material supporting member, an internal layer positioned opposite to said recording material supporting member with respect to said surface layer for absorbing oil deposited on said recording material supporting member, and a sponge layer disposed inside said internal layer, wherein a material of said internal layer is different from that of said surface layer and has a higher oleophilicity than that of a material of said surface layer.

32. An image forming apparatus according to claim 1 or 31, further comprising an image bearing member for bearing plural images, and transfer means for transferring the images of said image bearing member in succession in superposed manner, onto the recording material supported by said recording material supporting member.

33. An image forming apparatus according to claim 32, wherein said image bearing member is adapted to bear images of plural colors.

34. An image forming apparatus, comprising:

a recording material supporting member for supporting and transporting a recording material;

image forming means for forming an image on the recording material supported by said recording material supporting member;

polishing means, having polishing particles provided on a surface thereof and a holding portion for holding said polishing particles, for polishing said recording material supporting member;

power supply means; and memory means for memorizing a number of the recording materials subjected to image formation, wherein said polishing means polishes said recording material supporting member when said power supply means of said apparatus is turned on from a turned-off state, while the number memorized by said memory means is within a predetermined range.

35. An image forming apparatus according to claim 34, wherein said polishing particles are alumina particles.

36. An image forming apparatus according to claim 34, wherein the recording material supported by said recording material supporting member is comprised of paper, and said polishing means is adapted to remove paper dust deposited on said recording material supporting member.

37. An image forming apparatus according to claim 34, wherein said recording material supporting member is adapted to support said recording material by electrostatic force.

38. An image forming apparatus according to claim 37, further comprising an image bearing member for bearing an image and transfer means for transferring the image of said image bearing member, at a transfer position, to the recording material supported by said recording material supporting member, wherein the radius of curvature X of said recording material supporting member at said transfer position and the radius of curvature Y of said image bearing member at said transfer position satisfy a relationship $Y \geqq X/2$.

39. An image forming apparatus according to claim 38, wherein a relationship $Y \geqq X/1.1$ is preferably satisfied.

40. An image forming apparatus according to claim 34, further comprising detection means for detecting temperature and humidity, wherein a polishing operation of said polishing means is controlled according to a result of detection by said detection means.

41. An image forming apparatus according to claim 40, wherein an absolute moisture amount is calculated from the result of detection of said detection means, and a polishing operation of said polishing means is inhibited when the absolute moisture amount is less than a predetermined value.

42. An image forming apparatus according to claim 34, further comprising cleaning means for cleaning said recording material supporting member after a polishing operation by said polishing means.

43. An image forming apparatus according to claim 42, further comprising an oil cleaning member for cleaning oil deposited on said recording material supporting member, wherein said oil cleaning member is adapted to effect the oil cleaning operation prior to the polishing operation of said polishing means.

44. An image forming apparatus according to claim 43, wherein said cleaning means is adapted to clean said recording material supporting member prior to the oil cleaning operation by said oil cleaning member.

45. An image forming apparatus according to claim 43, wherein said oil cleaning member includes a surface layer for absorbing oil by contacting said recording material supporting member, and an internal layer positioned opposite to said recording material supporting member, with respect to said surface layer, and adapted to absorb the oil, wherein the material of said internal layer is different from that of said surface layer and has a higher oleophilicity than that of said surface layer.

46. An image forming apparatus according to claim 43, wherein said oil cleaning member is separated from said recording material supporting member during the polishing operation by said polishing means.

47. An image forming apparatus according to claim 43, wherein said polishing means, said cleaning means, and said oil cleaning member are arranged in this order, along a moving direction of said recording material supporting member, with respect to a separating position where the recording material is separated from said recording material supporting member.

48. An image forming apparatus according to claim 42, wherein said cleaning means is comprised of a brush.

49. An image forming apparatus according to claim 34, further comprising fixing means for fixing the image formed on the recording material, wherein said fixing means includes a pair of rotary members, and oil is applied to a rotary member at a side coming into contact with an unfixed image.

50. An image forming apparatus according to claim 49, wherein said recording material supporting member is adapted to support the recording material by contacting a first face of said recording material which bears, on said first face, an image fixed by said fixing means, and said image forming means is adapted to form an image on a second face of said recording material.

51. An image forming apparatus, comprising:

a recording material supporting member for supporting and transporting a recording material;

image forming means for forming an image on the recording material supported by said recording material supporting member;

polishing means, having polishing particles provided on a surface thereof and a holding portion for holding said polishing particles, for polishing said recording material supporting member; and cleaning means for cleaning said recording material supporting member after a polishing operation by said polishing means.

52. An image forming apparatus according to claim 51, wherein said polishing particles are alumina particles.

53. An image forming apparatus according to claim 51, wherein the recording material supported by said recording material supporting member is comprised of paper, and said polishing means is adapted to remove paper dust deposited on said recording material supporting member.

54. An image forming apparatus according to claim 51, wherein said recording material supporting member is adapted to support said recording material by electrostatic force.

55. An image forming apparatus according to claim 54, further comprising an image bearing member for bearing an image and transfer means for transferring the image of said image bearing member, at a transfer position, to the recording material supported by said recording material supporting member, wherein the radius of curvature X of said recording material supporting member at said transfer position and the radius of curvature Y of said image bearing member at said transfer position satisfy a relationship $Y \geqq X/2$.

56. An image forming apparatus according to claim 55, wherein a relationship $Y \geqq X/1.1$ is preferably satisfied.

57. An image forming apparatus according to claim 51, further comprising detection means for detecting temperature and humidity, wherein a polishing operation of said polishing means is controlled according to a result of detection by said detection means.

58. An image forming apparatus according to claim 57, wherein an absolute moisture amount is calculated from the result of detection of said detection means, and a polishing operation of said polishing means is inhibited when the absolute moisture amount is less than a predetermined value.

59. An image forming apparatus according to claim 51, further comprising an oil cleaning member for cleaning oil deposited on said recording material supporting member, wherein said oil cleaning member is adapted to effect the oil cleaning operation prior to a polishing operation of said polishing means.

60. An image forming apparatus according to claim 59, wherein said cleaning means is adapted to clean said recording material supporting member, prior to the oil cleaning operation by said oil cleaning member.

61. An image forming apparatus according to claim 59, wherein said oil cleaning member includes a surface layer for absorbing oil by contacting said recording material supporting member, and an internal layer positioned opposite to said recording material supporting member, with respect to said surface layer, and adapted to absorb the oil, wherein the material of said internal layer is different from that of said surface layer and has a higher oleophilicity than that of said surface layer.

62. An image forming apparatus according to claim 59, wherein said oil cleaning member is separated from said recording material supporting member during the polishing operation by said polishing means.

63. An image forming apparatus according to claim 59, wherein said polishing means, said cleaning means, and said oil cleaning member are arranged in this order, along a moving direction of said recording material supporting member, with respect to a separating position where the recording material is separated from said recording material supporting member.

64. An image forming apparatus according to claim 51, wherein said cleaning means is comprised of a brush.

65. An image forming apparatus according to claim 51, further comprising fixing means for fixing the image formed on the recording material, wherein said fixing means includes a pair of rotary members, and oil is applied to a rotary member at a side coming into contact with an unfixed image.

66. An image forming apparatus according to claim 65, wherein said recording material supporting member is adapted to support the recording material by contacting a first face of said recording material which bears, on said first face, an image fixed by said fixing means, and said image forming means is adapted to form an image on a second face of said recording material.

* * * * *

UNITED STATES PATENT AND TRADEMARK OFFICE

CERTIFICATE OF CORRECTION

PATENT NO. : 5,742,873

DATED : April 21, 1998

INVENTOR(S) : TAKAHIRO KUBO, ET AL.

It is certified that error appears in the above-identified patent and that said Letters Patent is hereby corrected as shown below:

COLUMN 7

Line 19, "a" should read --and--.

Line 54, "of the toted" should read --is subjected--.

COLUMN 10

Line 24, "same" should read --the same--.

COLUMN 11

Line 67, "same" should read --the same--.

COLUMN 12

Line 28, "same" should read --the same--.

UNITED STATES PATENT AND TRADEMARK OFFICE

CERTIFICATE OF CORRECTION

PATENT NO. : 5,742,873

DATED : April 21, 1998

INVENTOR(S) : TAKAHIRO KUBO, ET AL.

It is certified that error appears in the above-identified patent and that said Letters Patent is hereby corrected as shown below:

COLUMN 16

Line 23, "leaning" should read --cleaning--.

Signed and Sealed this

Sixth Day of April, 1999

*Attest:*

Q. TODD DICKINSON

*Attesting Officer*

*Acting Commissioner of Patents and Trademarks*